US009742109B1

(12) United States Patent
Senofsky et al.

(10) Patent No.: US 9,742,109 B1
(45) **Date of Patent: *Aug. 22, 2017**

(54) LOW PROFILE AND SMALL FORM FACTOR ELECTRICAL CONNECTOR SYSTEM

(71) Applicant: LED Inspirations, LLC, Cypress, TX (US)

(72) Inventors: Nicholas William Senofsky, Cypress, TX (US); Reed Jeffrey Holland, Tomball, TX (US); John Tyler Stenz, Cypress, TX (US); James Christopher Koonce, Cypress, TX (US)

(73) Assignee: LED Inspirations, LLC, Cypress, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/352,501

(22) Filed: Nov. 15, 2016

Related U.S. Application Data

(63) Continuation of application No. 15/136,959, filed on Apr. 24, 2016, now Pat. No. 9,531,121.

(51) Int. Cl.
*H01R 12/00* (2006.01)
*H01R 13/627* (2006.01)
(Continued)

(52) U.S. Cl.
CPC ..... *H01R 13/6273* (2013.01); *H01R 13/04* (2013.01); *H01R 13/10* (2013.01);
(Continued)

(58) Field of Classification Search
CPC ..... H01R 23/7068; H01R 23/7073; H01R 13/514; H05K 1/14
(Continued)

(56) References Cited

U.S. PATENT DOCUMENTS 6,319,071 B1 * 11/2001 Sato ..... H01R 4/185 439/701
7,841,872 B2 11/2010 Zhang et al.
(Continued)

OTHER PUBLICATIONS

International Search Report of the International Searching Authority (USPTO) for international application PCT/US2016/029091 dated Jul. 26, 2016.

(Continued)

*Primary Examiner* — Thanh Tam Le
(74) *Attorney, Agent, or Firm* — Basil M. Angelo; Angelo Mikeska PLLC

(57) ABSTRACT

An electrical connector system includes a connector and a header. The header includes a substantially T-shaped member having a proximal portion substantially rectangular in shape having a first width and a distal portion substantially rectangular in shape having a second width greater than the first width. A first and a second end portion of the distal portions are substantially T-shaped viewed end on. The first and the second end portions include a plurality of guides and shoulders. The connector includes a substantially rectangular member having a proximal portion having a first thickness and a distal portion having a second thickness less than the first thickness on a bottom side of the substantially rectangular member. The proximal portion includes first and second proximal feet and first and second distal feet. Each foot includes a foot retention shoulder and one or more guides.

19 Claims, 20 Drawing Sheets

(51) Int. Cl.

| | |
|---|---|
| ***H01R 13/631*** | (2006.01) |
| ***H01R 13/639*** | (2006.01) |
| ***H01R 13/10*** | (2006.01) |
| ***H01R 13/04*** | (2006.01) |
| ***H01R 13/642*** | (2006.01) |

(52) U.S. Cl.
CPC ..... *H01R 13/6275* (2013.01); *H01R 13/631* (2013.01); *H01R 13/639* (2013.01); *H01R 13/642* (2013.01)

(58) Field of Classification Search
USPC ..... 439/59–61, 79–80, 541.5, 660, 701
See application file for complete search history.

(56) References Cited

U.S. PATENT DOCUMENTS 8,142,206 B2 * 3/2012 Zhang ..... H01R 12/712 439/79
8,187,041 B2 * 5/2012 Ito ..... H01R 13/4361 439/541.5
8,408,947 B2 * 4/2013 Lorenzo Riera ..... H01R 13/506 439/701
8,602,825 B2 * 12/2013 Chen ..... H01R 13/6658 439/660
8,899,996 B2 * 12/2014 Lim ..... H01R 12/724 439/607.05

OTHER PUBLICATIONS

Written Opinion of the International Searching Authority (USPTO) for international application PCT/US2016/029091 dated Jul. 26, 2016.

* cited by examiner

LOW PROFILE AND SMALL FORM FACTOR ELECTRICAL CONNECTOR SYSTEM

CROSS-REFERENCE TO RELATED APPLICATIONS

This application is a continuation of U.S. patent application Ser. No. 15/136,959, filed on Apr. 24, 2016, issued as U.S. Pat. No. 9,531,121 on Dec. 27, 2016, which is hereby incorporated by reference in its entirety.

BACKGROUND OF THE INVENTION

Electrical connector systems provide an electrical interface between one or more wirings, circuits, devices, or systems. Conventional electrical connector systems typically include a connector that electro-mechanically mates with a header to provide an electrical interface between the connector and header by way of one or more electrical contact structures. When the connector is mated with the header, each contact typically makes electrical contact with a corresponding contact receiver to establish electrical connectivity. Conventional electrical connector systems are configured to convey power, signals, or both power and signals through the electrical interface.

BRIEF SUMMARY OF THE INVENTION

According to one aspect of one or more embodiments of the present invention, an electrical connector system includes a header and a connector. The header includes a substantially T-shaped member having a proximal portion substantially rectangular in shape having a first width and a distal portion substantially rectangular in shape having a second width greater than the first width. A first end portion of the distal portion that extends beyond a first end of the proximal portion may have a substantially T-shape viewed end on with a first proximal guide and a first distal guide on a top side of the first end portion and a first proximal shoulder and a first distal shoulder on bottom surfaces of the first end portion. A second end portion of the distal portion that extends beyond a second end of the proximal portion may have a substantially T-shape viewed end on with a second proximal guide and a second distal guide on the top side of the second end portion and a second proximal shoulder and a second distal shoulder on bottom surfaces of the second end portion. The header also includes a plurality of contact receivers disposed in the substantially T-shaped member. Each contact receiver includes a contact receiving portion exposed on a top side of the substantially T-shaped member and a substrate connection portion exposed on a bottom side of the substantially T-shaped member. The connector includes a substantially rectangular member having a proximal portion having a first thickness and a distal portion having a second thickness less than the first thickness on a bottom side of the substantially rectangular member. The proximal portion includes a first proximal foot and a first distal foot extending beyond the first thickness on a bottom side of the proximal portion of the substantially rectangular member along a first edge. The first proximal foot and the first distal foot each include a foot retention shoulder on an interior facing side of the respective foot and a foot guide on an exterior facing side of the respective foot. The proximal portion includes a second proximal foot and a second distal foot extending beyond the first thickness on the bottom side of the proximal portion of the substantially rectangular member along a second edge. The second proximal foot and the second distal foot each include a retention shoulder on an interior facing side of the respective foot and a foot guide on an exterior facing side of the respective foot. The connector includes a plurality of contacts. A portion of each contact is disposed in the substantially rectangular member, an exposed portion of each contact extends beyond the first thickness on the bottom side of the proximal portion of the substantially rectangular member within an area bounded by the first proximal foot, the first distal foot, the second proximal foot, and the second distal foot, and a distal portion of each contact extends beyond the second thickness on a bottom side of the distal portion of the substantially rectangular member.

According to one aspect of one or more embodiments of the present invention, an electrical connector system includes a header and a connector. The header includes a substantially T-shaped member having a first-width portion and a second-width portion. The second-width portion includes a first substantially T-shaped end portion and a second substantially T-shaped end portion, each end portion having a guide portion on a top-facing side and a shoulder portion on a bottom-facing surface of the end portion. The header includes a plurality of contact receivers disposed in the substantially T-shaped member. Each contact receiver includes a contact receiving portion exposed on a top-facing side of the substantially T-shaped member and a substrate connection portion exposed on a bottom-facing side of the substantially T-shaped member. The connector includes a substantially rectangular member having a first-thickness portion and a second-thickness portion, a first plurality of feet on a bottom-facing side of the first-thickness portion along a first edge, and a second plurality of feet on the-bottom-facing side of the first-thickness portion along a second edge, wherein each foot of the first and the second plurality of feet includes a foot retention shoulder and a plurality of feet guides. The connector includes a plurality of contacts. A portion of each contact is disposed in the substantially rectangular member, an exposed portion of each contact extends beyond the first-thickness portion on the bottom-facing side of the first-thickness portion within an area bounded by the first and the second plurality of feet, and a distal portion of each contact extends beyond the second-thickness portion on the bottom-facing side of the first-thickness portion.

Other aspects of the present invention will be apparent from the following description and claims.

DETAILED DESCRIPTION OF THE INVENTION

Figure 1A:
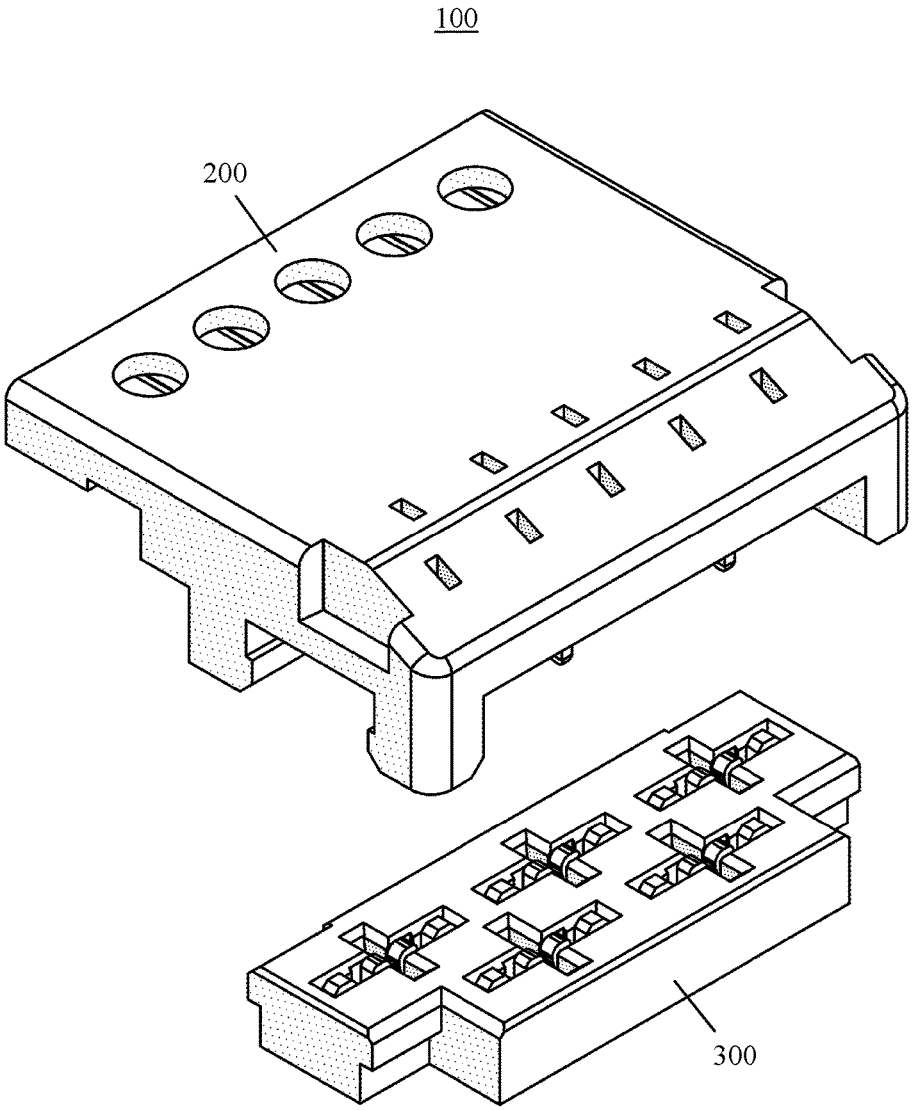
FIG. 1A shows a perspective view of an electrical connector system in an unconnected state in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a detailed understanding of the present invention. In other instances, well-known features to one of ordinary skill in the art are not described to avoid obscuring the description of the present invention.

There are a vast number of applications in which electrical and mechanical connectivity is required between disconnected or discontinuous wirings, circuits, devices, or systems. The electrical, mechanical, and safety performance requirements of a given application typically dictate the type or kind of electrical connector system employed. Consequently, a large number of unique electrical connector systems have been devised in an effort to meet these needs. However, a number of applications presently exist, and others will be conceived of in the future, that have stringent electrical, mechanical, and safety performance requirements that no existing electrical connector system can satisfy. For these reasons and others, research and development in the area of electrical connector system design is, and remains, ongoing.

A Light-Emitting-Diode ("LED") is a solid-state semiconductor device that emits visible light when there is a sufficient voltage drop across its anode and cathode (and corresponding forward bias current flow). The amount of visible light output may vary based on the amount of the voltage drop and the forward bias current. While there are a number of tradeoffs to the use of LEDs, in certain applications they offer a number of advantages over conventional incandescent lighting. For example, LEDs offer a smaller form factor, with the ability to direct the output of light, with near instantaneous switching between on and off. In addition, LEDs provide a substantially longer lifetime, reduced power consumption, and improved power efficiency over conventional incandescent lights. For these reasons and others, LEDs are now being used in a number of residential and commercial lighting applications, including LED strip lighting applications.

In LED strip lighting applications, a plurality of LEDs are typically disposed on a reel of a flexible printed circuit ("FPC") substrate that includes printed circuitry within, or disposed on the surface of, the flexible substrate. Typically, one side of the FPC substrate includes double-sided mounting tape and the other side includes a plurality of surface-mounted LEDs and other components. The FPC substrate may be encapsulated in a protective coating. The mounting tape allows the LED strip lighting to be easily mounted in space-constrained areas, such as, for example, under kitchen cabinetry. At least one distal end of the LED strip lighting includes a power and control interface where power and/or control signals are input to provide power to, and control the operation of, the LED strip lighting. While National Electric Code ("NEC") class II-rated lighting fixtures may be rated for less than 100 watt operation, commercial LED strip lighting may draw as much as 6.25 amperes of current when operated in a 24 volt DC system rated for 150 watt operation. Because LED strip lighting is typically custom installed on site in space-constrained and hard to reach areas, the use of soldered wiring to provide power and/or control signals is not feasible. Even if it solderable wiring were used, the lack of mechanical support in such an approach tends to promote electrical and mechanical failure over time. As such, conventional electrical connector systems have been used to provide power and/or control signals to the LED strip lighting, but such systems do not meet the stringent electrical, mechanical, and safety performance requirements demanded by current applications, including small form factor LED strip lighting applications.

Conventional electrical connector systems suffer from a number of issues, including large profile and footprint and poor electrical performance, mechanical performance, long-term reliability, and safety. Conventional electrical connector systems typically have a sizeable footprint that does not fit in the space-constrained areas where LED strip lighting is typically placed, interfere mechanically with the LEDs, cast shadows, interfere, or otherwise obstruct the provision of light by the nearest LEDs, fit in an irregular manner that promotes electrical and mechanical failure by loosening over time, tend to be very fragile, and give rise to a number of serious safety issues. Commercially available LED strip lighting typically has a low profile and small footprint having a height of approximately 4 millimeters and a width of approximately 12 millimeters. Because commercially available LED strip lighting typically has LEDs distributed equidistance along the length of the strip to provide uniform light along its length, one or more LEDs are disposed near the interface between the conventional electrical connector system and the distal end of the LED strip lighting. However, conventional electrical connector systems towers over at least the nearest LED and possibly others, casting shadows or blocking the provision of light. This can cause undesirable and commercially unacceptable dead zones in the lighting profile of the LED strip lighting.

Conventional electrical connector systems are also prone to electrical and mechanical failure. Many small form factor conventional electrical connector systems are fragile and use very delicate contact structures that, upon installation, can easily deform giving rise to opens and shorts that result in electrical failure. Conventional electrical connector systems also lack mechanical strength and the mechanical connection between connector and header loosens over time, ultimately resulting in electrical failure. Because of the voltages and currents used, as conventional electrical connector systems loosen, undesirable electrical arcing may occur that can cause fires and serious injury or death, especially in applications where, for example, LED strip lighting is mounted on flammable surfaces, such as wooden cabinetry.

Accordingly, in one or more embodiments of the present invention, an electrical connector system provides high current connectivity in a low profile and small form factor with a substantially vertical mating scheme that provides reliable connectivity and high retention force, well-suited to space-constrained applications that have stringent electrical, mechanical, and safety performance requirements.

FIG. 1A shows a perspective view of an electrical connector system 100 in an unconnected state in accordance with one or more embodiments of the present invention. Electrical connector system 100 includes a connector 200 that may be removably attached to a header 300, thereby providing electrical and mechanical connectivity. In certain embodiments, the connector 200 may be partially shrouded in a cable assembly (not shown) and the header 300 may be secured to a substrate (not shown) such as a FPC, a printed circuit board ("PCB"), or other substrate material.

Figure 1B:
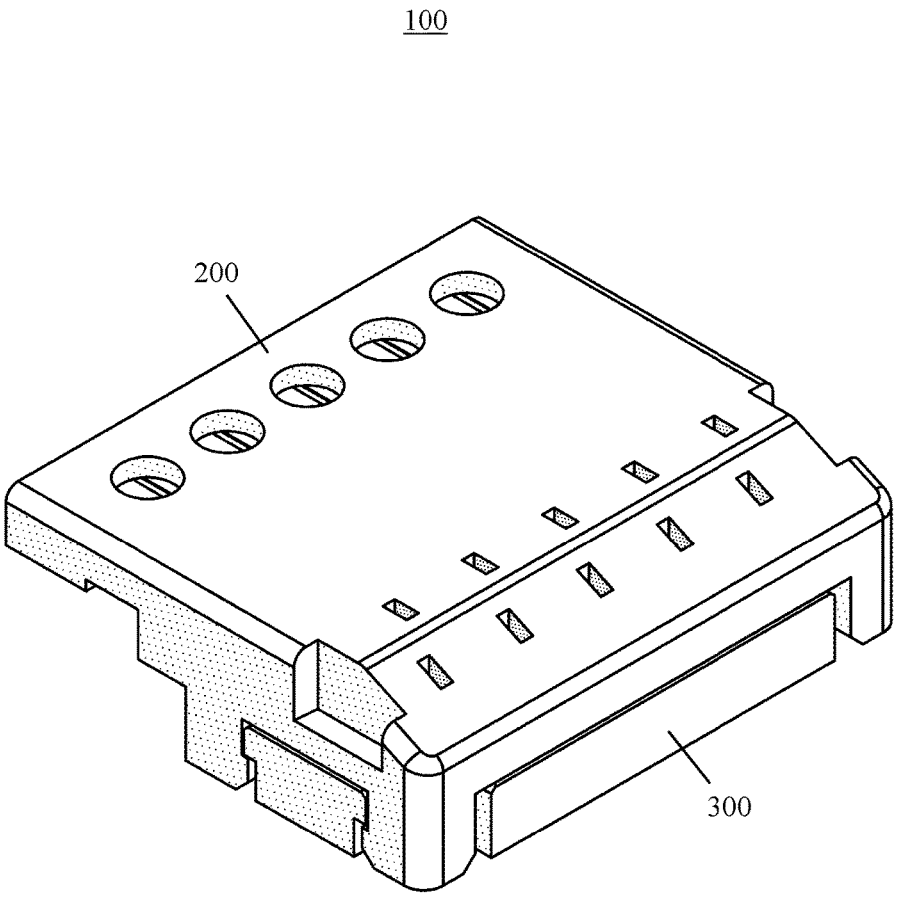
FIG. 1B shows a perspective view of the electrical connector system in a connected state in accordance with one or more embodiments of the present invention.

Continuing, FIG. 1B shows a perspective view of the electrical connector system 100 in a connected state in accordance with one or more embodiments of the present invention. Connector 200 removably attaches to header 300 with a vertical mating scheme that provides an extremely low profile and small form factor when connected, allowing for the use of the electrical connector system 100 in applications where the profile of the connector system 100 itself is substantially constrained. The vertical mating scheme uses hand force to achieve mechanical connectivity between the connector 200 and the header 300 and, once connected, provides high retention force that resists unintentional disconnection, providing safe and reliable electrical and mechanical connectivity. While there is high retention force when connected, the connector 200 may be easily detached from the header 300 by applying tangential hand force to the distal portion of the connector 200.

Figure 2A:
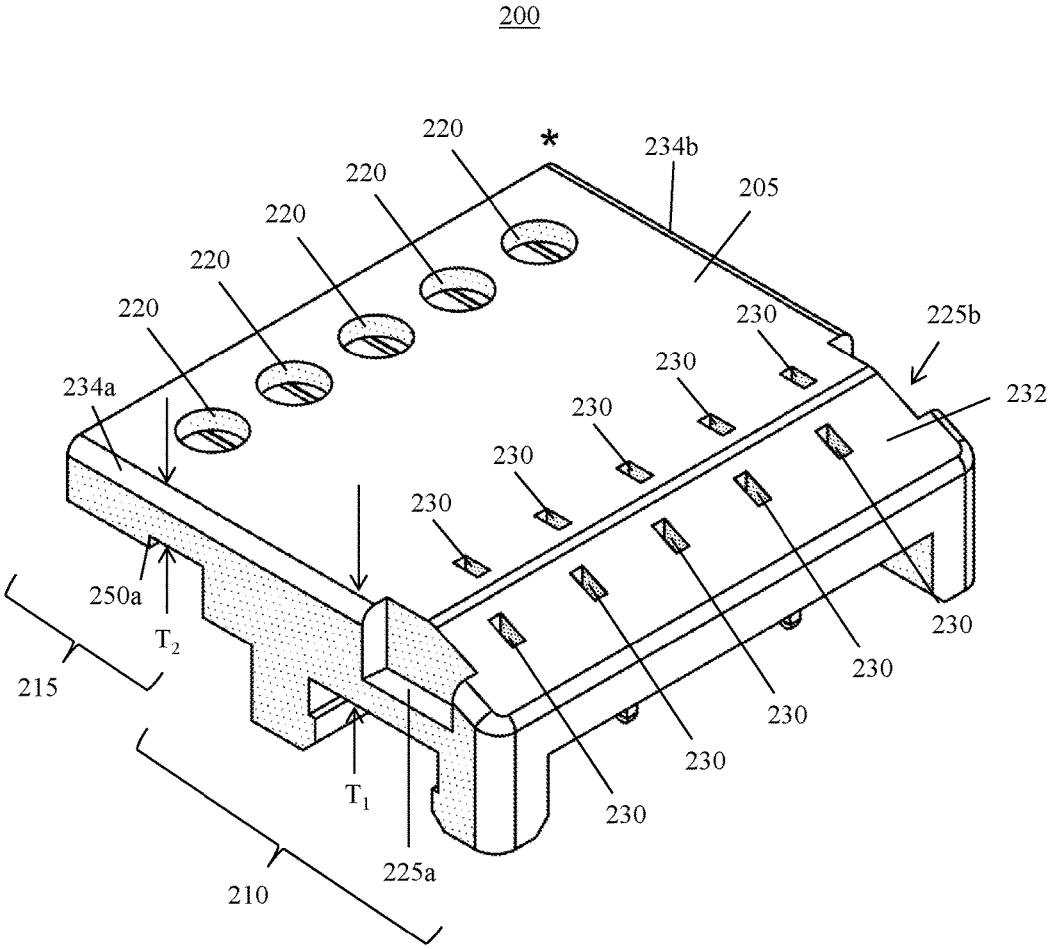
FIG. 2A shows a top-side perspective view of a connector of an electrical connector system in accordance with one or more embodiments of the present invention.

FIG. 2A shows a top-side perspective view of a connector 200 of an electrical connector system (100 of FIG. 1) in accordance with one or more embodiments of the present invention. In certain embodiments, connector 200 includes a substantially rectangular member 205 having a proximal portion 210 with a first thickness, $T_1$, and a distal portion 215 with a second thickness, $T_2$, that is less than the first thickness, $T_1$. In other embodiments, connector 200 may include a member 205 of a different shape, including, but not limited to, substantially square (not shown), which have a first thickness portion (not shown) and a second thickness portion (not shown) that is less than the first thickness portion.

In certain embodiments, the top-facing surface of connector 200 may be substantially planar whereas the bottom-facing surface exposes the differences in thickness between the proximal portion 210 and the distal portion 215. In certain embodiments, member 205 may be composed of a heat resistant polyamide resin, such as, for example, PA9T® resin with 30% glass fill. One of ordinary skill in the art will recognize that any other suitable material, or compositions of material, may be used in accordance with one or more embodiments of the present invention.

In certain embodiments, a top side proximal facing portion of member 205 may optionally be beveled 232. The beveling 232 may be linear or chamfered or arcuate (not shown). Advantageously, beveling 232 reduces the shadow cast by the connector 200 and reduces the blockage of light by the connector 200 in, for example, LED strip lighting applications (not independently illustrated). A first lengthwise edge 234*a* and a second lengthwise edge 234*b* of member 205 may optionally be beveled to serve as guides when connector 200 is incorporated into a shrouded cable assembly (not shown). One of ordinary skill in the art will recognize that other portions of member 205 may be beveled in accordance with one or more embodiments of the present invention.

In certain embodiments, connector 200 may optionally include a plurality of shroud cutouts 220 disposed on a top-facing side of the distal portion 215 of member 205. The plurality of shroud cutouts 220 may be configured to secure a shrouded cable assembly (not shown) to the connector 200 when used as part of a cable assembly (not shown). While the plurality of shroud cutouts 220 are shown as five circular cutouts, one of ordinary skill in the art will recognize that the number and the shape and/or size of the cutouts may vary based on an application or design in accordance with one or more embodiments of the present invention.

In certain embodiments, connector 200 may optionally include a first retention clip shoulder 225*a* disposed on a first side of the proximal portion 210 of member 205 and a second retention clip shoulder 225*b* disposed on a second side of the proximal portion 210 of member 205. The optional retention clip shoulders 225*a*, 225*b* may be configured to receive a retention clip (not shown) in applications where even more retention force than that provided by the connector 200 and the header (300 of FIG. 1) is required.

In certain embodiments, connector 200 may optionally include a plurality of contact retention cutouts 230 disposed on a top side of the proximal portion of member 205. The plurality of contact retention cutouts 230 may be used to secure a portion of one or more contacts (not shown) to the connector 200.

Figure 2B:
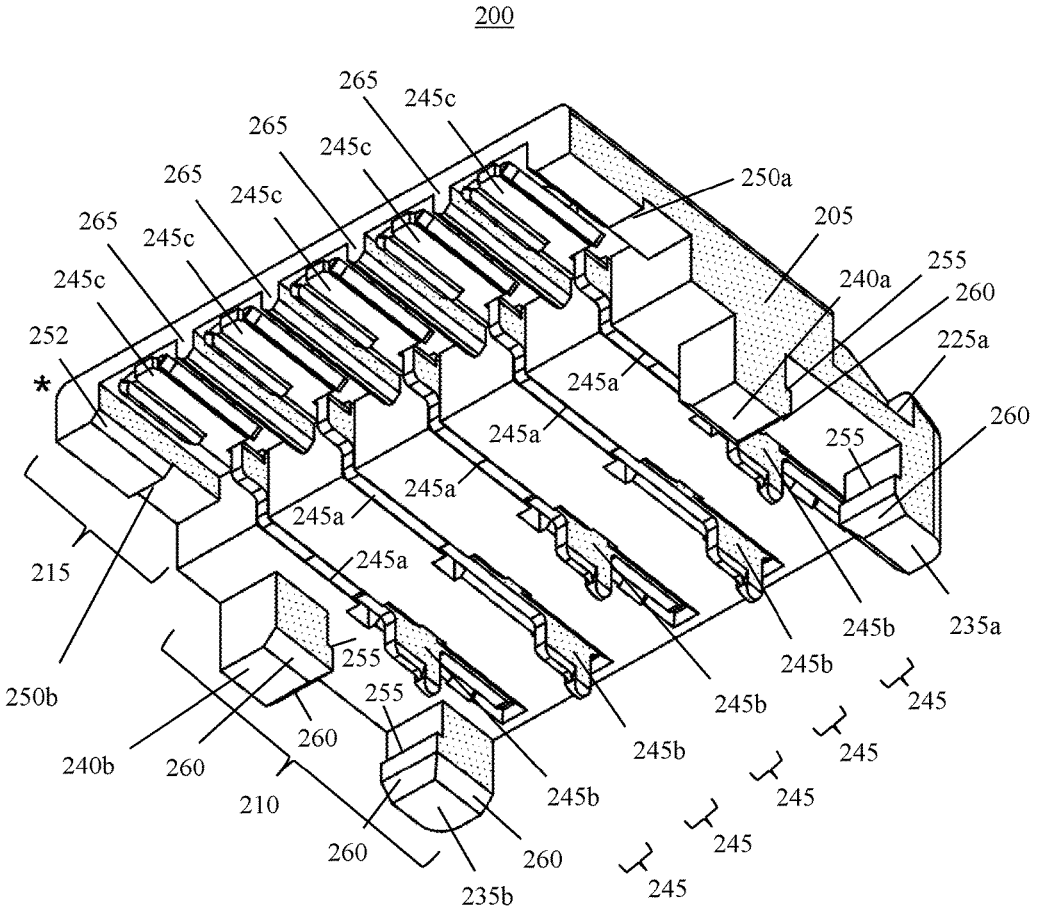
FIG. 2B shows a bottom-side perspective view of the connector of the electrical connector system in accordance with one or more embodiments of the present invention.

Continuing, FIG. 2B shows a bottom-side perspective view of the connector 200 of the electrical connector system (100 of FIG. 1) in accordance with one or more embodiments of the present invention. The proximal portion 210 of member 205 may include a first proximal foot 235*a* and a first distal foot 240*a* that extend beyond the first thickness, $T_1$, on a bottom side of the proximal portion 210, along a first edge. The first proximal foot 235*a* and the first distal foot 240*a* may each include a foot retention shoulder 255 on an interior facing side of the respective foot 235*a*, 240*a* and one or more foot guides 260 on exterior facing sides of the respective foot 235*a*, 240*a*. The proximal portion 210 of member 205 may also include a second proximal foot 235*b* and a second distal foot 240*b* that extend beyond the first thickness, $T_1$, on a bottom side of the proximal portion 210, along a second edge. The second proximal foot 235*b* and the second distal foot 240*b* may each include a foot retention shoulder 255 on an interior facing side of the respective foot 235*b*, 240*b* and one or more foot guides 260 on exterior facing sides of the respective foot 235*b*, 240*b*. The one or more foot guides 260 assist in the mating of connector 200 with header 300 using hand force and, once engaged with header 300, the foot retention shoulders 255 provide substantial retention force. In certain embodiments, one or more of the foot guides 260 may be linear or chamfered. In other embodiments, one or more of the foot guides 260 may be arcuate (not shown). In still other embodiments, foot guides 260 may include a planar surface or a planar surface with angled portions. One of ordinary skill in the art will recognize that the foot guides 260 may vary based on an application or design in accordance with one or more embodiments of the present invention.

The distal portion 215 of member 205 may include a first shroud shoulder 250*a* that extends beyond the second thickness, $T_2$, on a bottom side of the distal portion 215, along the first edge and a second shroud shoulder 250*b* that extends beyond the second thickness, $T_2$, on the bottom side of the distal portion 215, along the second edge. The first and the second shroud shoulders 250*a*, 250*b* are configured to secure a shrouded cable assembly (not shown) to the connector 200 when used as part of a cable assembly (not shown). The first and the second shroud shoulders 250*a*, 250*b* may include one or more shroud guides 252 to assist in mating the shrouded cable assembly (not shown) to the connector 200 when connector 200 is used as part of a shrouded cable assembly (not shown). In certain embodiments, one or more of the shroud guides 252 may be linear or chamfered. In other embodiments, one or more of the shroud guides 252 may be arcuate (not shown). One of ordinary skill in the art will recognize that the shroud guides 252 may vary based on an application or design in accordance with one or more embodiments of the present invention.

A plurality of electrical contacts 245 may be removably attached to connector 200. A portion 245*a* of each contact 245 may be disposed in member 205, an exposed portion 245*b* of each contact 245 may extend beyond the first thickness, $T_1$, on the bottom side of the proximal portion 210 of member 205, within an area bounded by the first proximal foot 235*a*, the first distal foot 240*a*, the second proximal foot 235*b*, and the second distal foot 240*b* forming the contact interface, and a distal portion 245*c* of each contact 245 may extend beyond the second thickness, $T_2$, on a bottom side of the distal portion 215 of member 205 forming the wiring interface. The exposed portion 245*b* of each contact 245 may be configured to electrically connect to a contact receiving portion (not shown) of a corresponding contact receiver (not shown) of the header (300 of FIG. 1). The portion 245*a* of each contact 245 disposed in member 205 may be used to secure the contact 245 to member 205 and to electrically connect the exposed portion 245*b* to the distal portion 245*c*. The distal portion 245*c* of each contact provides a wiring interface for the contact 245 to a wiring (not shown) when connector 200 is incorporated into a cable, such as, for example, a shrouded cable assembly (not shown). Member 205 may optionally include one or more partitions 265 that help prevent accidental short circuiting between adjacent distal portions 245*c* of contacts 245. One of ordinary skill in the art will recognize that the number and type or kind of electrical contacts 245 may vary based on an application or design in accordance with one or more embodiments of the present invention. One of ordinary skill in the art will also recognize that each of the disposed portions 245*a*, exposed portions 245*b*, and distal portions 245*c* may vary in shape or size based on the needs of a given application or design in accordance with one or more embodiments of the present invention.

Each contact 245 of the connector 200 mates with a corresponding contact receiving portion (not shown) of a contact receiver (not shown) of the header (300 of FIG. 1) forming an electrical contact structure (not independently illustrated). The current carrying capability of the electrical connector system (100 of FIG. 1) may be determined by the type or kind of electrical contact structures, the number of electrical contact structures, the shape and metal surface area of the electrical contact structures, and the wiring interface internal to the connector 200, or cable assembly in which it is disposed, of the electrical connector system (100 of FIG. 1).

In one or more embodiments of the present invention, the type or kind of electrical contact structure may vary based on an application or design. For example, the type or kind of electrical contact structure may vary based on the wiring scheme, the number of required contacts, and/or the current carrying requirements for a given application or design. While certain embodiments contemplate the use of a single type or kind of electrical contact structure, one of ordinary skill in the art will recognize that more than one type or kind of contact structure may be used in a given application or design. One of ordinary skill in the art will also recognize that contact-type electrical contact structures are shown in the figures, but any other suitable electrical contact structure may be used in accordance with one or more embodiments of the present invention. Contact-type electrical contact structures include an exposed portion 245*b* of contact 245 that is substantially planar and mates with a substantially V-shaped contact receiver (not shown) that is rotated 90 degrees from that of the contact 245.

In one or more embodiments of the present invention, the number of electrical contact structures used may also vary based on an application or design. For example, the number of electrical contact structures used within the system may vary based on the type or kind of electrical contact structures, the wiring scheme, and the current carrying requirements for a given application or design. While the embodiment shown in the figure discloses the use of 5 contact-type electrical contact structures, which is suitable for applications such as, for example, LED strip lighting applications that wish to drive a single color LED strip, Red, Green, & Blue ("RGB") LED strip, or Red, Green, Blue, & White ("RGB+W") LED strip, one of ordinary skill in the art will recognize that the number of electrical contact structures employed may vary based on an application or design in accordance with one or more embodiments of the present invention.

Figure 2C:
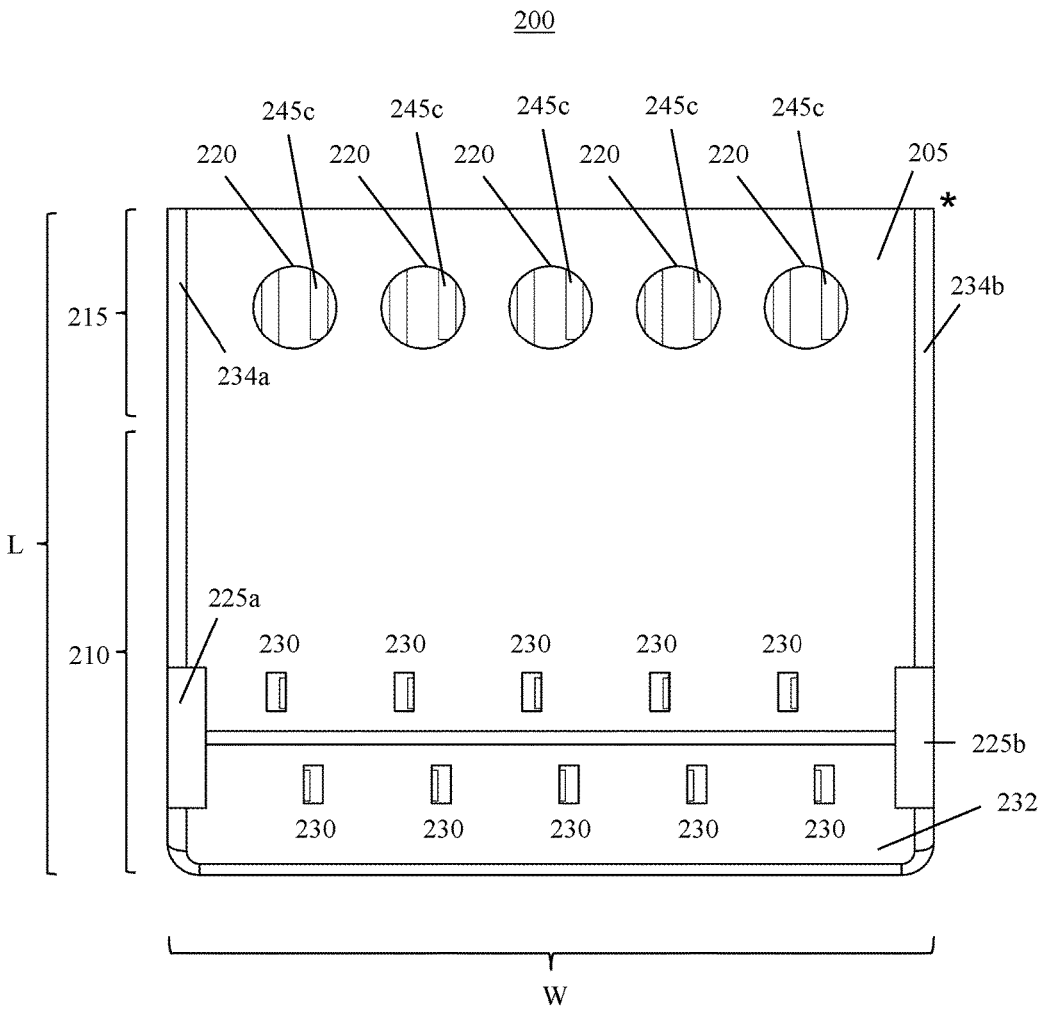
FIG. 2C shows a top-side plan view of the connector of the electrical connector system in accordance with one or more embodiments of the present invention.

Continuing, FIG. 2C shows a top-side plan view of the connector 200 of the electrical connector system (100 of FIG. 1) in accordance with one or more embodiments of the present invention. In certain embodiments, electrical connector system 100 provides a low profile and small footprint form factor that provides secure and reliable electrical and mechanical connectivity in space-constrained applications. This low profile and small footprint form factor allows for use in high current carrying applications in a extremely small footprint where a high degree of retention force is required to maintain electrical and mechanical integrity. In certain embodiments, connector 200 may have a width, W, of less than or equal to approximately 12 millimeters, suitable for use with certain commercial LED strip lighting applications, and a length, L, of less than approximately 11 millimeters. In other embodiments, connector 200 may have a width, W, in a range between approximately 1 millimeter and approximately 20 millimeters and a length, L, in a range between approximately 1 millimeter and approximately 20 millimeters. In still other embodiments, connector 200 may have a width, W, in a range between approximately 20 millimeters and approximately 100 millimeter and a length, L, in a range between approximately 20 millimeters and approximately 100 millimeters. However, one of ordinary skill in the art will recognize that other lengths, widths, and scales of connector 200 may be used and may vary based on an application or design in accordance with one or more embodiments of the present invention.

Figure 2D:
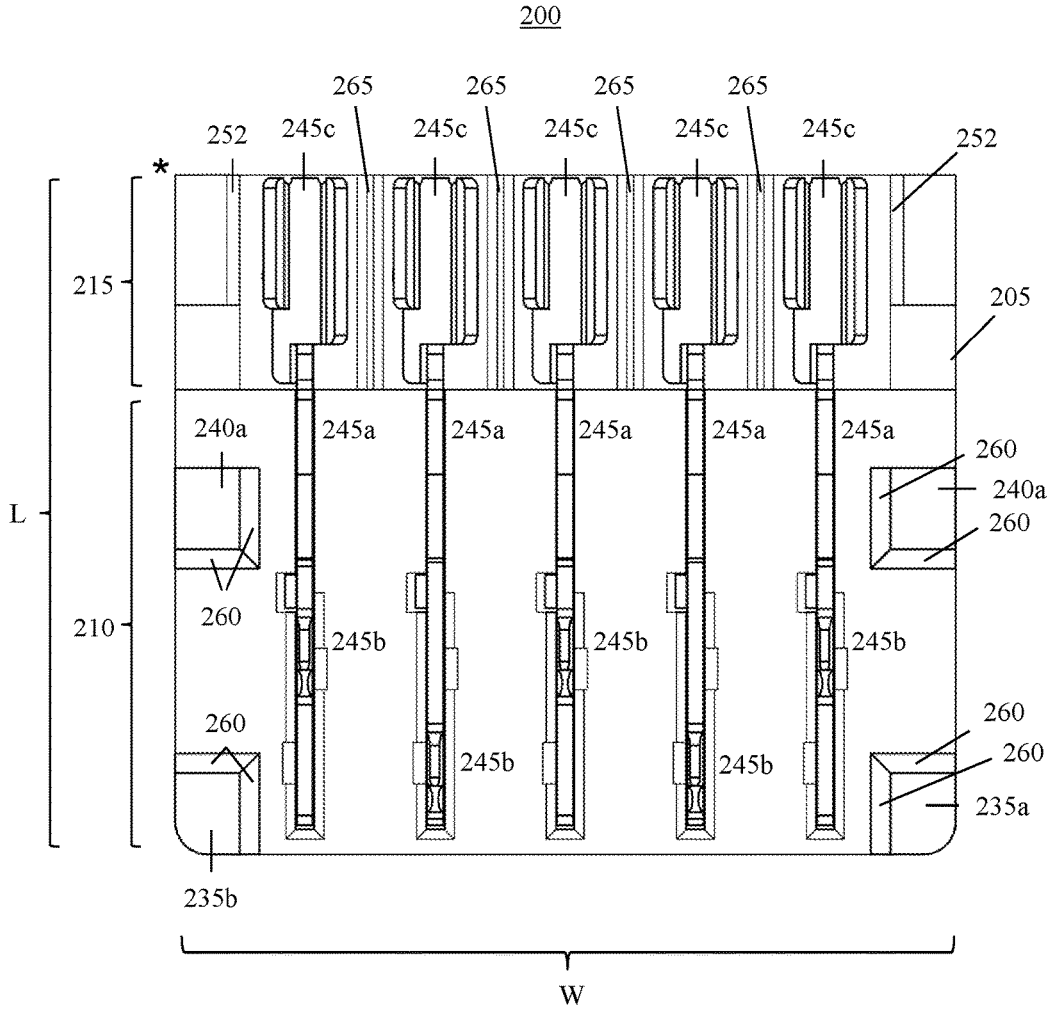
FIG. 2D shows a bottom-side plan view of the connector of the electrical connector system in accordance with one or more embodiments of the present invention.

Continuing, FIG. 2D shows a bottom-side plan view of the connector 200 of the electrical connector system (100 of FIG. 1) in accordance with one or more embodiments of the present invention. This bottom-side plan view provides another view of the various foot guides 260 and shroud guides 252 that assist in the mating of connector 200 to header (300 of FIG. 1) of electrical connector system (100 of FIG. 1).

Figure 2E:
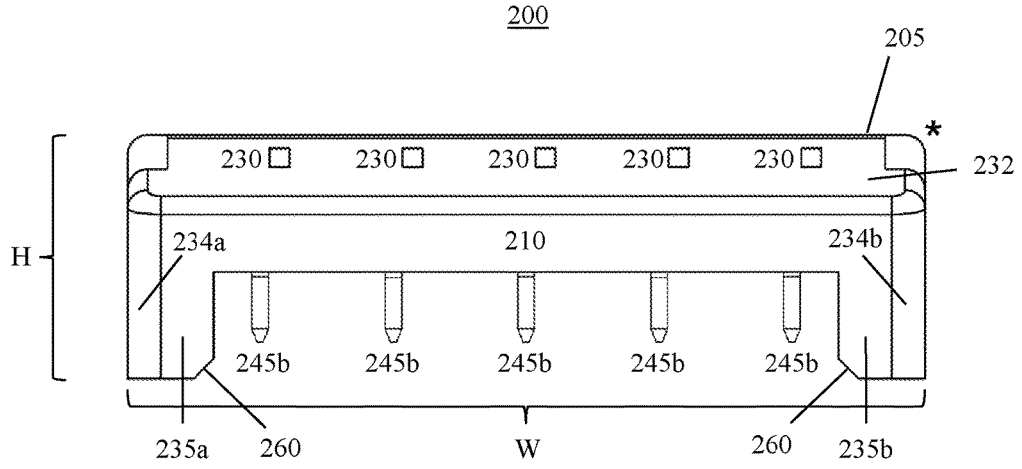
FIG. 2E shows a front elevation view of the connector of the electrical connector system in accordance with one or more embodiments of the present invention.

Continuing, FIG. 2E shows a front elevation view of the connector 200 of the electrical connector system (100 of FIG. 1) in accordance with one or more embodiments of the present invention. In certain embodiments, connector 200 may have a height, H, of less than 4 millimeters, suitable for use with space-constrained applications, such as, for example, LED strip lighting applications. In other embodiments, connector 200 may have a height, H, in a range between approximately 1 millimeter and approximately 20 millimeters. In still other embodiments, connector 200 may have a height, H, in a range between approximately 20 millimeter and approximately 100 millimeters. In certain embodiments, because of the design of the electrical connector system (100 of FIG. 1), when connector 200 is mated with its header (300 of FIG. 1), the height (not shown) of the electrical connector system (100 of FIG. 1) may have a connected height of slightly more than that of connector 200 alone, but still less than 4 millimeters. This low profile and small form factor allow for the use of the electrical connector system (100 of FIG. 1) in LED strip lighting applications where any additional height would obstruct or block the provision of LED light from the LED strip lighting. In addition, the beveled face 232 of the front facing portion of member 205 further reduces the apparent height of the electrical connector system (100 of FIG. 1) in applications where an LED may be disposed on an FPC substrate very near the placement of the electrical connector system. One of ordinary skill in the art will recognize that the height and scale of connector 200 may vary based on an application or design in accordance with one or more embodiments of the present invention.

Figure 2F:
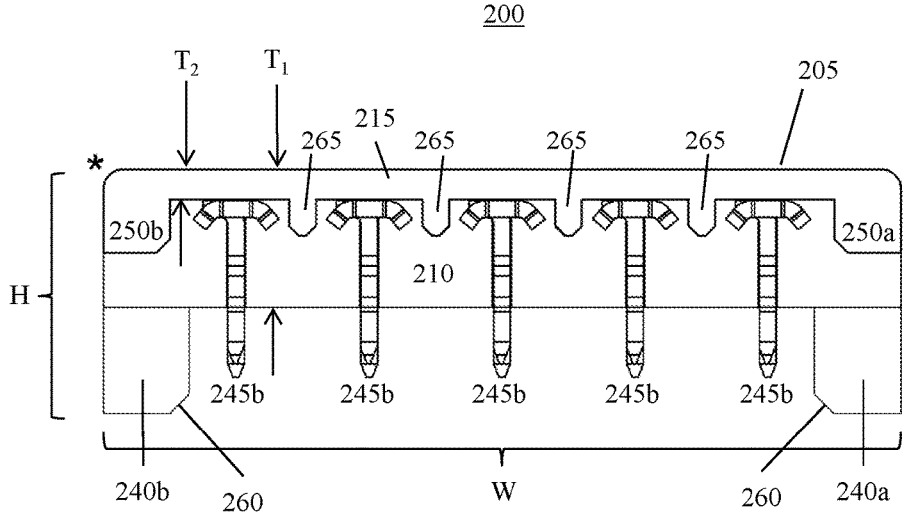
FIG. 2F shows a rear elevation view of the connector of the electrical connector system in accordance with one or more embodiments of the present invention.
Figure 2G:
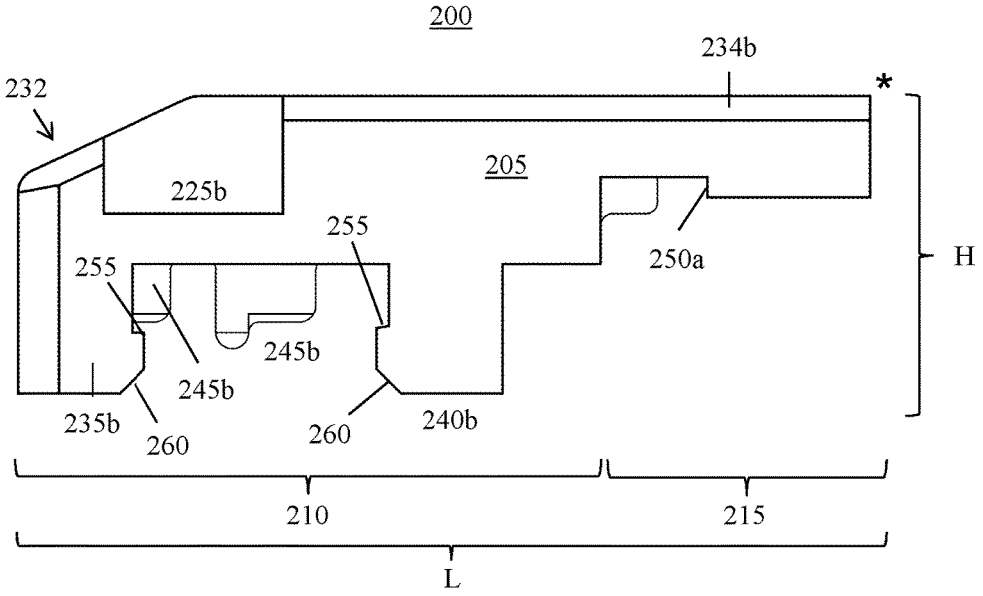
FIG. 2G shows a right-side elevation view of the connector of the electrical connector system in accordance with one or more embodiments of the present invention.
Figure 2H:
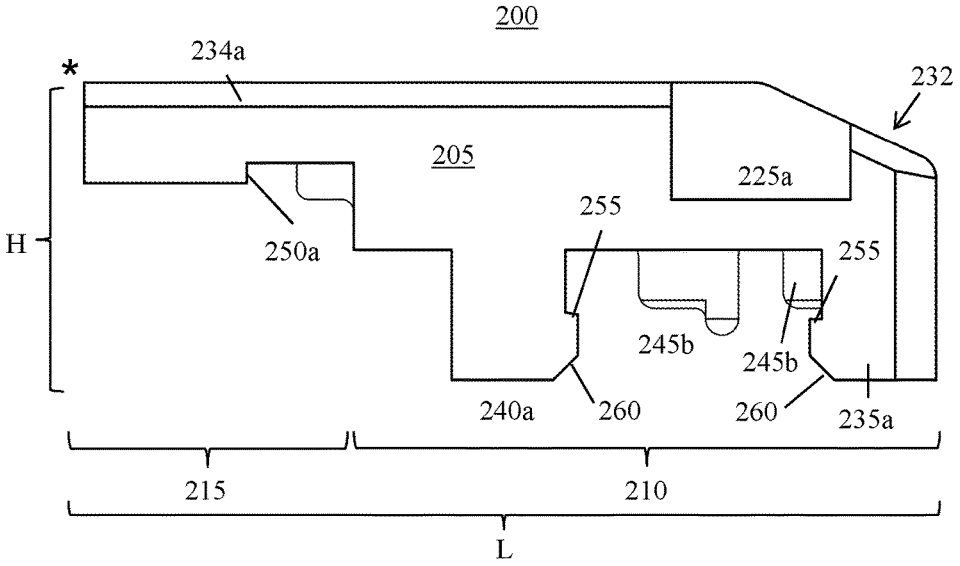
FIG. 2H shows a left-side elevation view of the connector of the electrical connector system in accordance with one or more embodiments of the present invention.

Continuing, FIG. 2F shows a rear elevation view of the connector 200 of the electrical connector system (100 of FIG. 1) in accordance with one or more embodiments of the present invention. Continuing, FIG. 2G shows a right-side elevation view of the connector 200 of the electrical connector system (100 of FIG. 1) in accordance with one or more embodiments of the present invention. Continuing, FIG. 2H shows a left-side elevation view of the connector 200 of the electrical connector system (100 of FIG. 1) in accordance with one or more embodiments of the present invention.

Figure 3A:
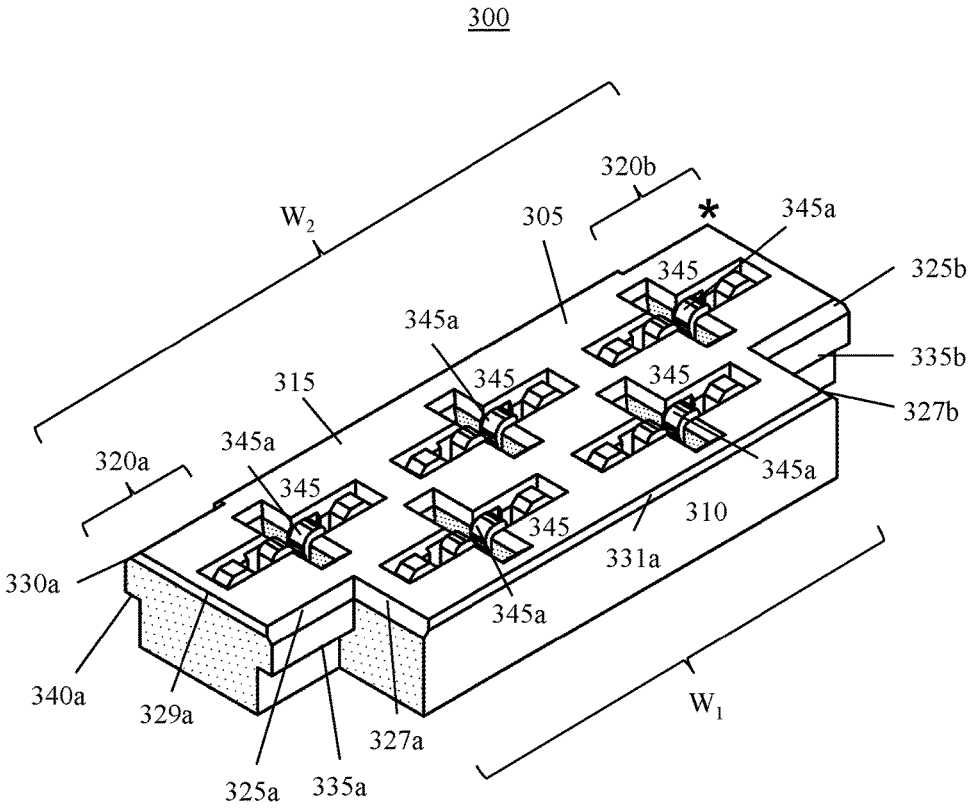
FIG. 3A shows a top-side perspective view of a header of an electrical connector system in accordance with one or more embodiments of the present invention.

FIG. 3A shows a top-side perspective view of a header 300 of an electrical connector system (100 of FIG. 1) in accordance with one or more embodiments of the present invention. In certain embodiments, header 300 may be a substantially T-shaped member 305 having a proximal portion 310 substantially rectangular in shape having a first width, $W_1$, and a distal portion 315 substantially rectangular in shape having a second width, $W_2$, that is greater than the first width, $W_1$. In other embodiments, header 300 may include a member 305 of any other suitable shape having a first-width portion and a second-width portion, where the first width portion is smaller than the second width portion (not shown). One of ordinary skill in the art will recognize that other shapes may be used in accordance with one or more embodiments of the present invention.

A first end portion 320*a* of distal portion 315, which extends beyond a first end of the proximal portion 310, may have a substantially T-shape when viewed end on. The first end portion 320*a* may include a first proximal guide 325*a* (proximal facing side) and a first distal guide 330*a* (distal facing side) on a top side of the first end portion 320*a*. The first proximal guide 325*a* and the first distal guide 330*a* assist when mating a connector (200 of FIG. 2) to header 300. In certain embodiments, the first proximal guide 325*a* and the first distal guide 330*a* may be linear or chamfered. In other embodiments, the first proximal guide 325*a* and the first distal guide 330*a* may be arcuate (not shown). One of ordinary skill in the art will recognize that any other suitable shape may be used to assist in the mating of connector (200 of FIG. 2) to header 300 in accordance with one or more embodiments of the present invention.

The first end portion 320*a* may also include a first proximal shoulder 335*a* and a first distal shoulder 340*a* on bottom surfaces of the first end portion 320*a*. The first proximal shoulder 335*a* makes contact with foot retention shoulder (255 of FIG. 2) of the first proximal foot (235*a* of FIG. 2) of the connector (200 of FIG. 2) and the first distal shoulder 340*a* makes contact with foot retention shoulder (255 of FIG. 2) of first distal foot (240*a* of FIG. 2) of the connector (200 of FIG. 2). The first proximal shoulder 335*a* and the first distal shoulder 340*a* assist in securing the connector (200 of FIG. 2) in place when the connector (200 of FIG. 2) is snapped into place on the header 300.

A second end portion 320*b* of distal portion 315, which extends beyond a second end of the proximal portion 310, may have a substantially T-shape when viewed end on. The second end portion 320*b* may include a second proximal guide 325*b* (proximal facing side) and a second distal guide 330*b* (not shown, on distal facing side) on a top side of the second end portion 320*b*. The second proximal guide 325*b* and the second distal guide 330*b* (not shown, on distal facing side) assist when mating a connector (200 of FIG. 2) to header 300. In certain embodiments, the second proximal guide 325*b* and the second distal guide 330*b* may be linear or chamfered. In other embodiments, the second proximal guide 325*b* and the second distal guide 330*b* may be arcuate (not shown). One of ordinary skill in the art will recognize that any other suitable shape may be used to assist in the mating of connector (200 of FIG. 2) to header 300 in accordance with one or more embodiments of the present invention.

The second end portion 320*b* may also include a second proximal shoulder 335*b* and a second distal shoulder 340*b* (not shown, on distal facing side) on bottom surfaces of the second end portion 320*b*. The second proximal shoulder 335*b* makes contact with foot retention shoulder (255 of FIG. 2) of the second proximal foot (235*b* of FIG. 2) of the connector (200 of FIG. 2) and the second distal shoulder 340*b* makes contact with foot retention shoulder (255 of FIG. 2) of second distal foot (240*b* of FIG. 2) of the connector (200 of FIG. 2). The second proximal shoulder 335*b* and the second distal shoulder 340*b* assist in securing the connector (200 of FIG. 2) in place when the connector (200 of FIG. 2) is snapped into place on the header 300.

In certain embodiment, a proximal widthwise edge on a top side of member 305 may have a proximal widthwise guide 331*a*. A distal substantially widthwise edge (not including end portions 320), may include a distal substantially widthwise guide 331*b* (not shown, on distal facing side). A first proximal lengthwise edge on a top side of member 305 may have a first proximal lengthwise guide 327*a*. A first distal lengthwise edge on a top side of member 305 may have a first distal lengthwise guide 329*a*. A second proximal lengthwise edge on a top side of member 305 may have a second proximal lengthwise guide 327*b*. A second distal lengthwise edge on a top side of member 305 may have a second distal lengthwise guide (329*b* of FIG. 3C). The proximal widthwise guide 331, the distal substantially widthwise guide 331*b*, the first proximal lengthwise guides 327*a*, 327*b*, and the first distal lengthwise guides 329*a*, 329*b* may be linear or chamfered or arcuate (not shown). In other embodiments, the top-facing surface of header 300 may be substantially planar. One of ordinary skill in the art will recognize that the top facing surface or surfaces of header 300 may have a different shape or design, including the disposition of guides, in accordance with one or more embodiments of the present invention.

In certain embodiments, member 305 may be composed of a heat resistant polyamide resin, such as, for example, PA9T® resin, with 30% glass fill. One of ordinary skill in the art will recognize that other material, or compositions of materials, may be used in accordance with one or more embodiments of the present invention.

A plurality of contact receivers 345 may be fixedly attached to header 300 and disposed in member 305. Each contact receiver 345 may include a contact receiving portion 345*a* exposed on a top side of member 305 and a substrate connection portion (345*b*) exposed on a bottom side of member 305. Each contact receiving portion 345*a* mates with a corresponding contact (245 of FIG. 2) of the connector (200 of FIG. 2) forming an electrical contact structure (not independently illustrated).

Figure 3B:
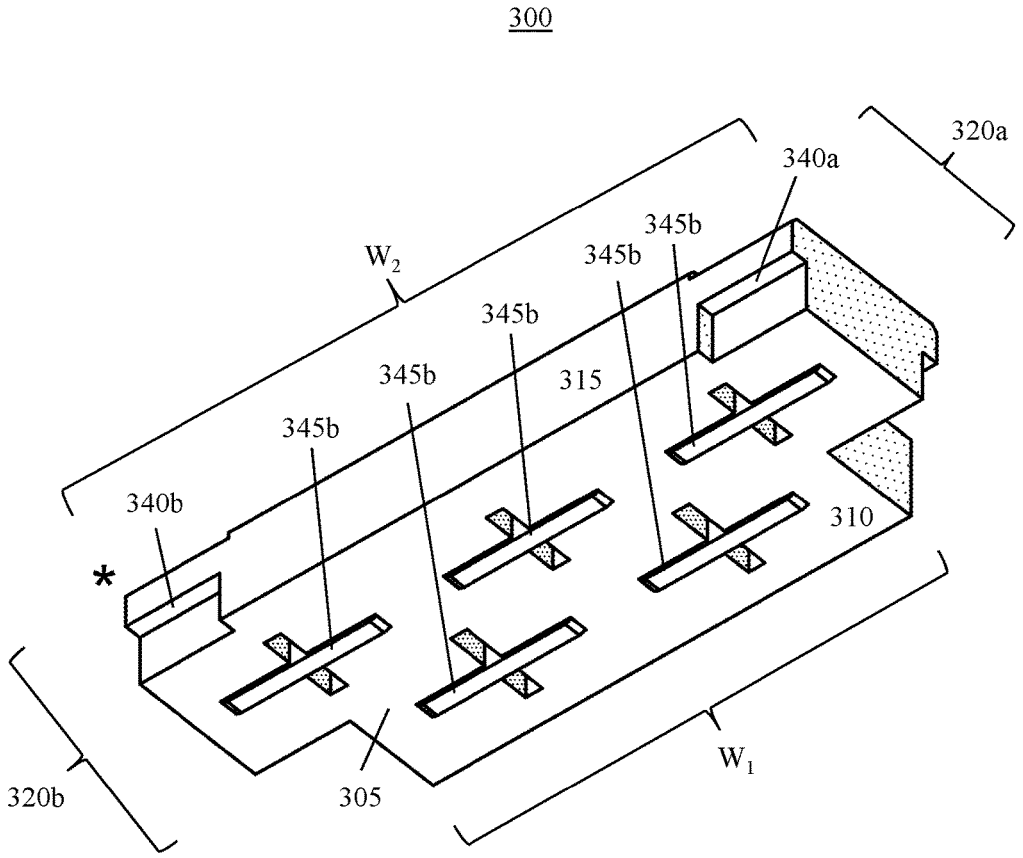
FIG. 3B shows a bottom-side perspective view of the header of the electrical connector system in accordance with one or more embodiments of the present invention.

Continuing, FIG. 3B shows a bottom-side perspective view of the header 300 of the electrical connector system (100 of FIG. 1) in accordance with one or more embodiments of the present invention. In this view, the first distal shoulder 340*a* and the second distal shoulder 340*b* are shown. Substrate connection portion 345*b* of each contact receiver 345 may be exposed on the bottom facing side of header 300. In embodiments where header 300 is intended to be surface mounted, substrate connection portions 345*b* may be reflowable or solderable surfaces configured to make electrical contact with corresponding pads on an FPC, PCB, or other substrate.

Figure 3C:
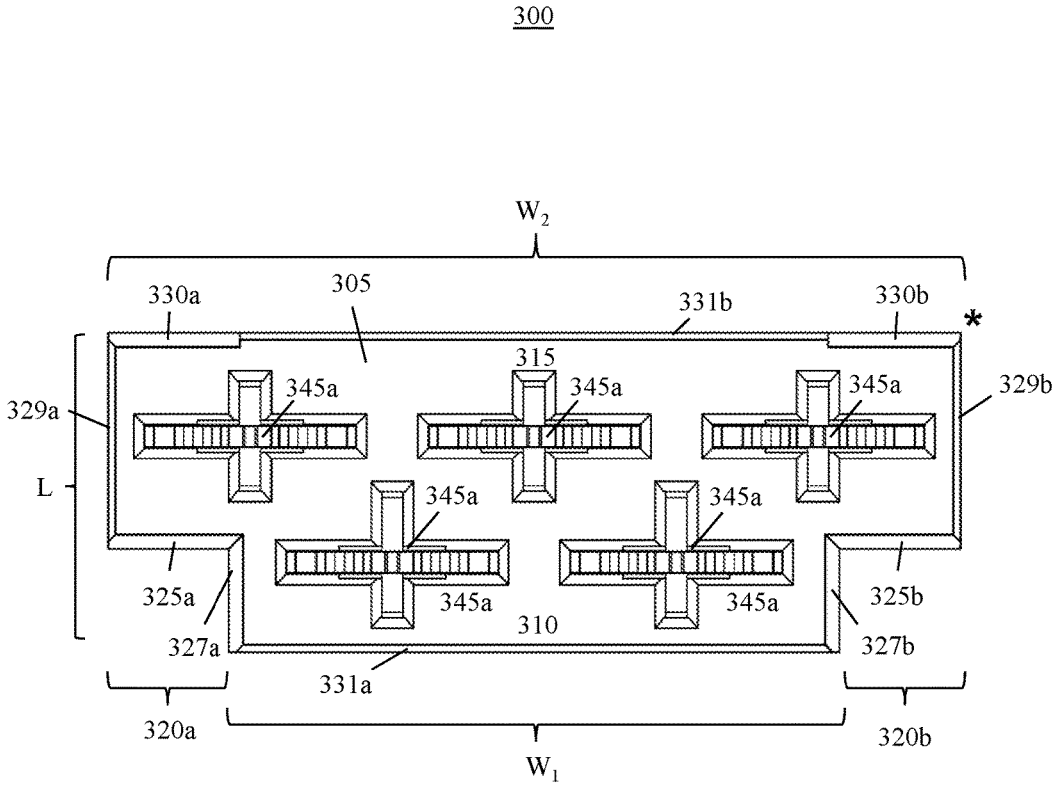
FIG. 3C shows a top-side plan view of the header of the electrical connector system in accordance with one or more embodiments of the present invention.

Continuing, FIG. 3C shows a top-side plan view of the header 300 of the electrical connector system (100 of FIG. 1) in accordance with one or more embodiments of the present invention. In this view, many of the top-side guides are shown. From front to back, first proximal lengthwise guide 327*a*, proximal widthwise guide 331*a*, second proximal lengthwise guide 327*b*, and distal substantially widthwise guide 331*b* assist in the mating of connector (200 of FIG. 2) to header 300. With respect to the first end portion 320*a*, first proximal guide 325*a*, first distal lengthwise guide 329*a*, and first distal guide 330*a* also assist in the mating of connector (200 of FIG. 2) to header 300. With respect to the second end portion 320*b*, second proximal guide 325*b*, second distal lengthwise guide 329*b*, and second distal guide 330*b* also assist in the mating of connector (200 of FIG. 2) to header 300.

In certain embodiments, the first width, $W_1$, of the proximal portion 310 may have a width of less than approximately 9 millimeters, the second width, $W_2$, of the distal portion 315 may have a width of less or equal to approximately 12 millimeters, and the length, L, of header 300 may have a length of less than approximately 5 millimeters. In other embodiments, the first width, $W_1$, of the proximal portion 310 may have a width in a range between approximately 1 millimeter and approximately 20 millimeters, the second width, $W_2$, of the distal portion 315 may have a width in a range between approximately 1 millimeter and approximately 20 millimeters, and the length, L, of header 300 may have a length in a range between approximately 1 millimeter and approximately 20 millimeters. In still other embodiments, the first width, $W_1$, of the proximal portion 310 may have a width in a range between approximately 20 millimeters and approximately 100 millimeters, the second width, $W_2$, of the distal portion 315 may have a width in a range between approximately 20 millimeters and approximately 100 millimeters, and the length, L, of header 300 may have a length in a range between approximately 20 millimeters and approximately 100 millimeters. One of ordinary skill in the art will recognize that the first width, $W_1$, the second width, $W_2$, and the length, L, may vary based on an application or design in accordance with one or more embodiments of the present invention.

Figure 3D:
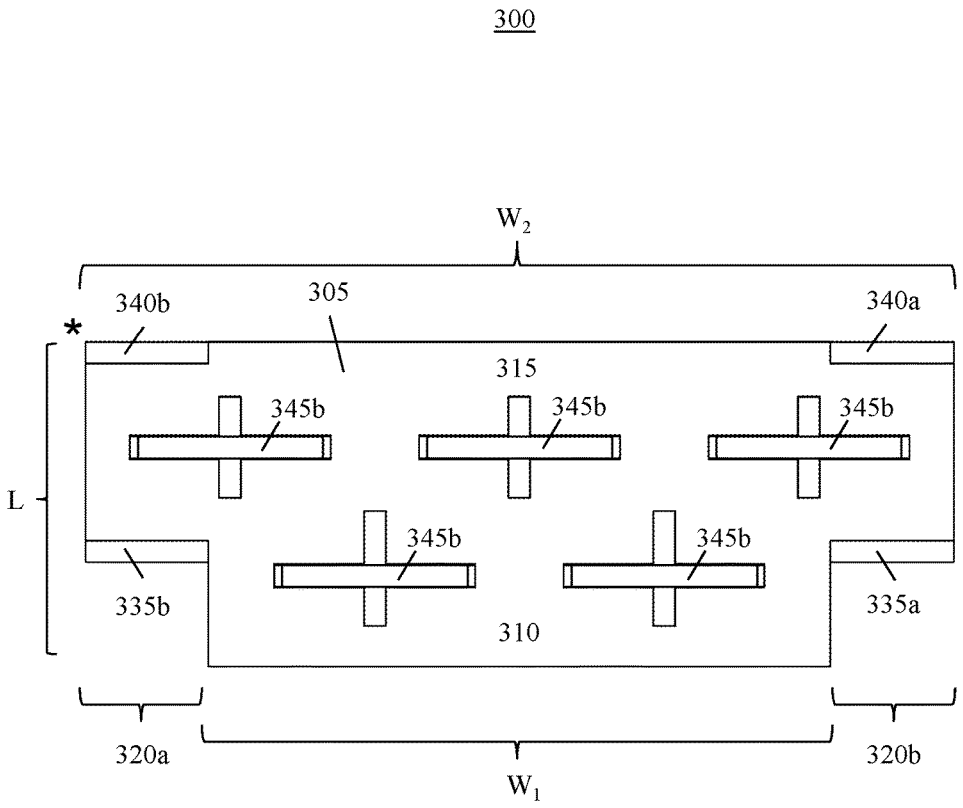
FIG. 3D shows a bottom-side plan view of the header of the electrical connector system in accordance with one or more embodiments of the present invention.

Continuing, FIG. 3D shows a bottom-side plan view of the header 300 of the electrical connector system (100 of FIG. 1) in accordance with one or more embodiments of the present invention. The first proximal shoulder 335*a* and the first distal shoulder 340*a* of the first end portion 320*a* and the second proximal shoulder 335*b* and the second distal shoulder 340*b* of the second end portion 320*b* are shown.

Figure 3E:
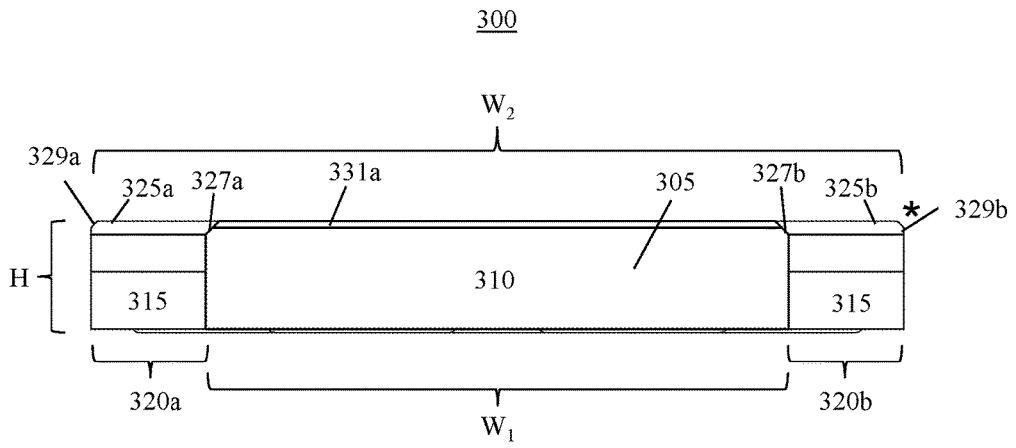
FIG. 3E shows a front elevation view of the header of the electrical connector system in accordance with one or more embodiments of the present invention.

Continuing, FIG. 3E shows a front elevation view of the header 300 of the electrical connector system (100 of FIG.

1) in accordance with one or more embodiments of the present invention. In certain embodiments, header 300 may have a height of less than approximately 2 millimeters. One of ordinary skill in the art will recognize that the height may vary based on an application or design in accordance with one or more embodiments of the present invention. In certain embodiments, because of the design of the electrical connector system (100 of FIG. 1), when connector (200 of FIG. 2) is mated with header 300, the height (not shown) of the electrical connector system (100 of FIG. 1) may have a connected height of slightly more than that of connector 200 alone, but still less than 4 millimeters. The low profile and small form factor allow for the use of the electrical connector system (100 of FIG. 1) in LED strip lighting applications where any additional height would obstruct or block the provision of LED light from the LED strip lighting.

Figure 3F:
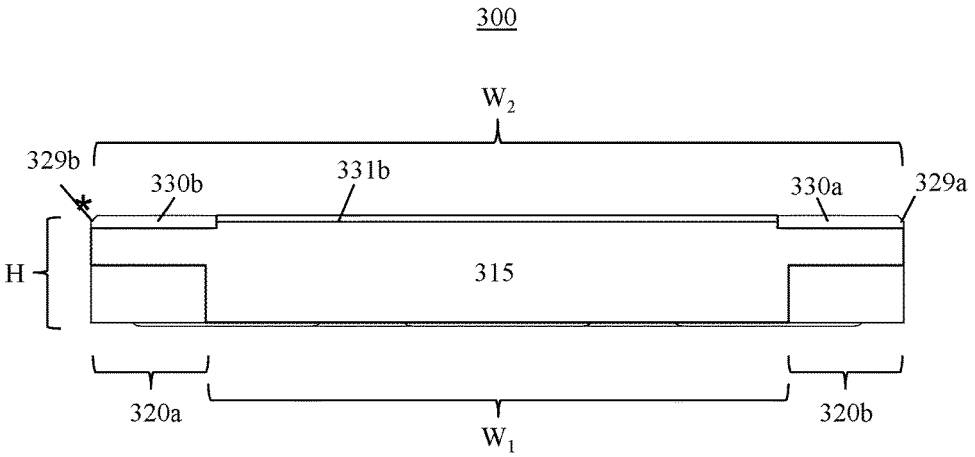
FIG. 3F shows a rear elevation view of the header of the electrical connector system in accordance with one or more embodiments of the present invention.
Figure 3G:
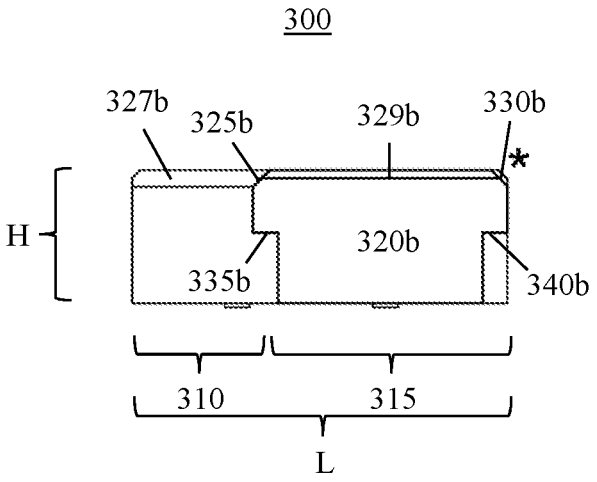
FIG. 3G shows a right-side elevation view of the header of the electrical connector system in accordance with one or more embodiments of the present invention.
Figure 3H:
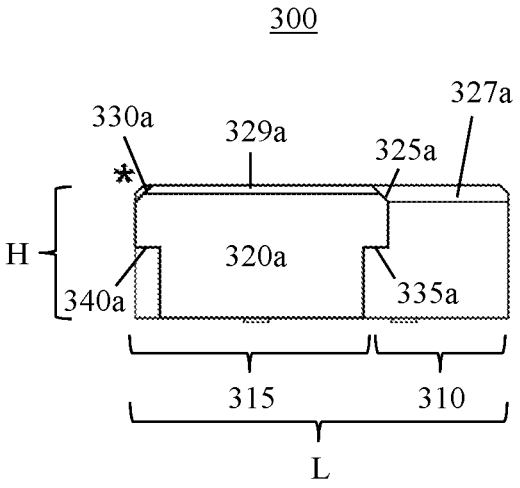
FIG. 3H shows a left-side elevation view of the header of the electrical connector system in accordance with one or more embodiments of the present invention.

Continuing, FIG. 3F shows a rear elevation view of the header 300 of the electrical connector system (100 of FIG. 1) in accordance with one or more embodiments of the present invention. FIG. 3G shows a right-side elevation view of the header 300 of the electrical connector system (100 of FIG. 1) in accordance with one or more embodiments of the present invention. FIG. 3H shows a left-side elevation view of the header 300 of the electrical connector system (100 of FIG. 1) in accordance with one or more embodiments of the present invention.

Figure 4:
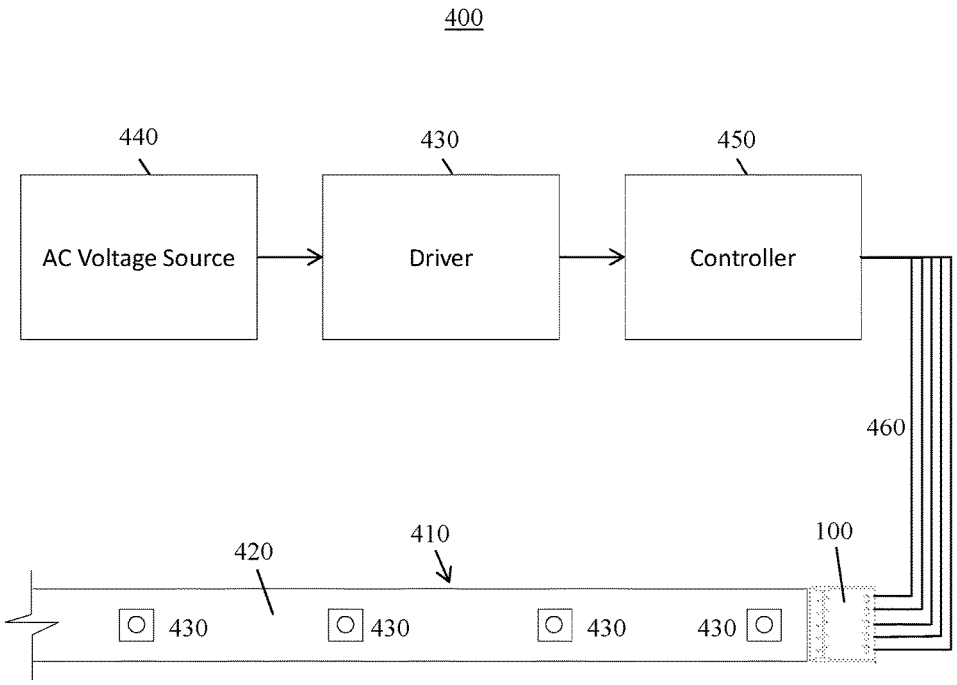
FIG. 4 shows a schematic view of an LED strip light application in accordance with one or more embodiments of the present invention.

FIG. 4 shows a schematic view of an LED strip lighting installation 400 in accordance with one or more embodiments of the present invention. LED strip lighting 410 is commonly used in residential and commercial lighting applications and is particularly well suited to space-constrained applications. Commercially available LED strip lighting 410 is typically sold as a spool-able reel that allows an installer to unspool and use as much strip lighting as is needed for a particular installation.

LED strip lighting 410 includes a flexible substrate 420, such as FPC or flexible printed electronics, on which a plurality of LEDs 430 and other surface mount components may be disposed. Double-sided mounting tape (not shown) is typically mounted on the opposing side of the flexible substrate 420. LED strip lighting 410 is typically very narrow. Commercially available strip lighting may have a width of 12 millimeters or less. In addition, LED strip lighting 410 is typically very thin, such that the flexible substrate 420, LEDs 430, and other surface mount components present a height profile of less than 5 millimeters. Surface mounted LEDs are typically distributed equidistant along a length of the flexible substrate 420. The power and/or control signals interface to the LED strip lighting 410 is typically very near one or more of the LEDs. Consequently, conventional electrical connector systems with large profiles tend to obscure or otherwise block the light provided by the LED, giving rise to undesirable dark areas.

In practice, an installer will arrive at an installation site with one or more reels of LED strip lighting 410. The installer will determine where the lighting is to be applied, cut out an appropriate amount of strip lighting from the reel, pull the tab off the mounting tape, and mount the lighting strip in the desired location. Because of the small footprint of the LED strip lighting, it may be mounted in hard to reach areas that are typically inaccessible. Once the strip lighting is mounted, a driver 430 inputs 120V AC voltage from a power source 440, such as a conventional wall outlet, and provides a DC voltage of the appropriate voltage for the application, such as, for example, 12 VDC or 24 VDC among other commonly used options. The DC voltage is provided to an LED controller 450 that provides some manner of interface that allows the end user of the lighting to control the behavior of the lighting, such as, on or off, adjust the brightness, or change the color of the light among other commonly available options. Typically, the output of the controller is a plurality of wires that provide power and/or control signals to the LED strip lighting.

In one or more embodiments of the present invention, a shrouded cable assembly 460 may be used as the wiring interface between controller 450 and LED strip lighting 410. Shrouded cable assembly 460 may include a plurality of wires, the first ends of which are individually shrouded and accessible for connection to the controller 450. The second ends of the plurality of wires are then fixedly connected to connector 100, which is then partially shrouded (not shown), as part of the shrouded cable assembly 460. The assembly of shrouded cable assembly 460 may be performed well in advance of the installation and may be provided as a commercially available cable that is purchased off the shelf. As such, the installer merely has to mount the LED strip lighting 410, provide power to the driver 430, connect the driver 430 to the controller 450, and connect the controller 450 to the LED strip lighting 410 using the shrouded cable assembly 460. Advantageously, this greatly reduces the amount of time required to perform an installation and results in a substantially improved electrical and mechanical connection that provides more reliable and safe operation over conventional electrical connector systems.

Figure 5A:
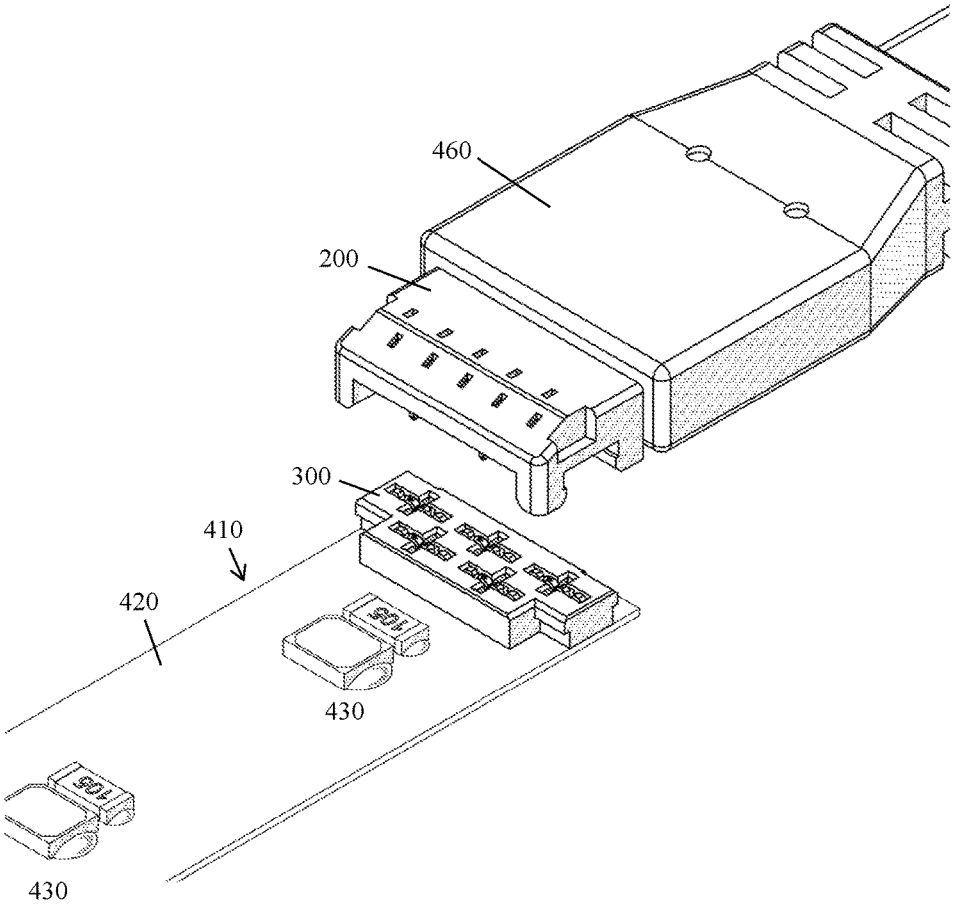
FIG. 5A shows a perspective view of a connector of an electrical connector system shrouded in a cable assembly and a header of the electrical connector system mounted to a flexible printed circuit in a disconnected state in accordance with one or more embodiments of the present invention.

FIG. 5A shows a perspective view of a connector 200 of an electrical connector system 100 shrouded in a cable assembly 460 and a header 300 of the electrical connector system 100 mounted to a flexible printed circuit 420 in a disconnected state in accordance with one or more embodiments of the present invention. In this embodiment, the LED strip lighting 410 includes a header 300 surface mounted on lighting 410, allowing for the quick and easy connection of power and control signals by way of shrouded cable assembly 460.

Figure 5B:
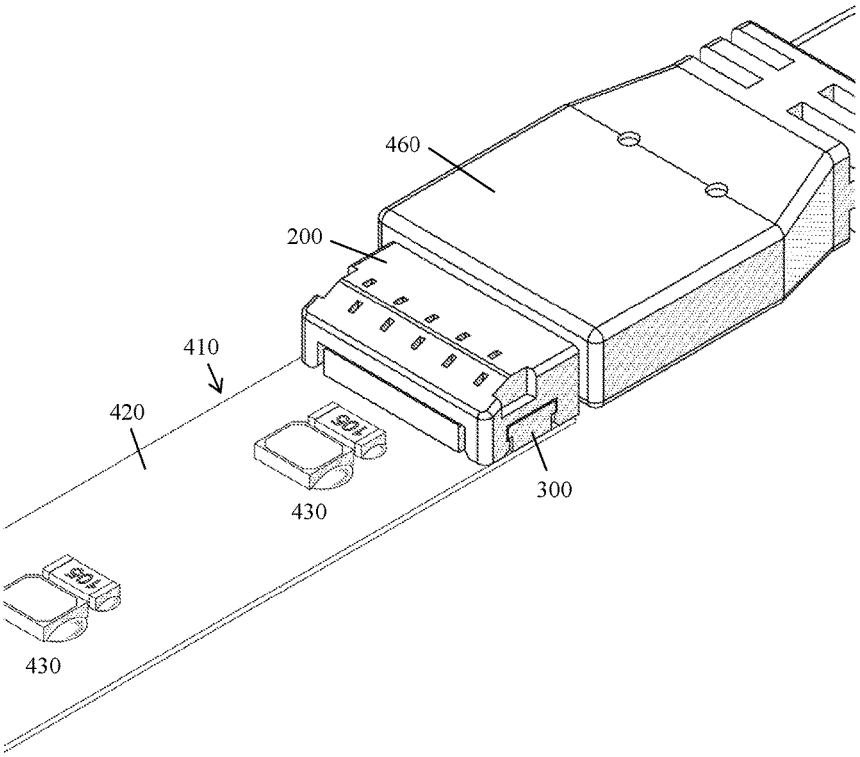
FIG. 5B shows a perspective view of the connector of the electrical connector system shrouded in the cable assembly and the header of the electrical connector system mounted to the flexible printed circuit in a connected state in accordance with one or more embodiments of the present invention.

Continuing, FIG. 5B shows a perspective view of the connector 200 of the electrical connector system 100 shrouded in the cable assembly 460 and the header 300 of the electrical connector system 100 mounted to the flexible printed circuit 420 in a connected state in accordance with one or more embodiments of the present invention.

Figure 5C:
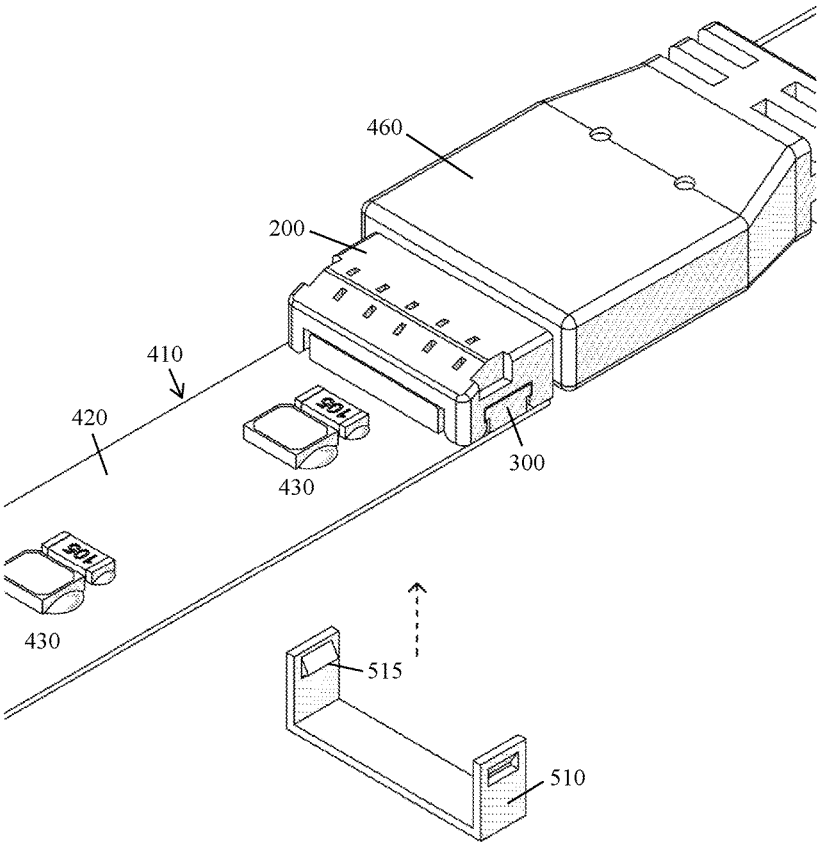
FIG. 5C shows a perspective view of the connector of the electrical connector system shrouded in the cable assembly and the header of the electrical connector system mounted to the flexible printed circuit in a connected state and an optional retention clip prior to placement in accordance with one or more embodiments of the present invention.

Continuing, FIG. 5C shows a perspective view of the connector 200 of the electrical connector system 100 shrouded in the cable assembly 460 and the header 300 of the electrical connector system 100 mounted to the flexible printed circuit 420 in a connected state and an optional retention clip 510 prior to placement in accordance with one or more embodiments of the present invention. While the design of electrical connector system 100 provides very high retention force, should additional retention force be required, an optional retention clip 510 may be used. Retention clip 510 includes a plurality of latches 515 capable of latching onto retention clip shoulders (225*a*, 225*b* of FIG. 2) of connector 100.

Figure 5D:
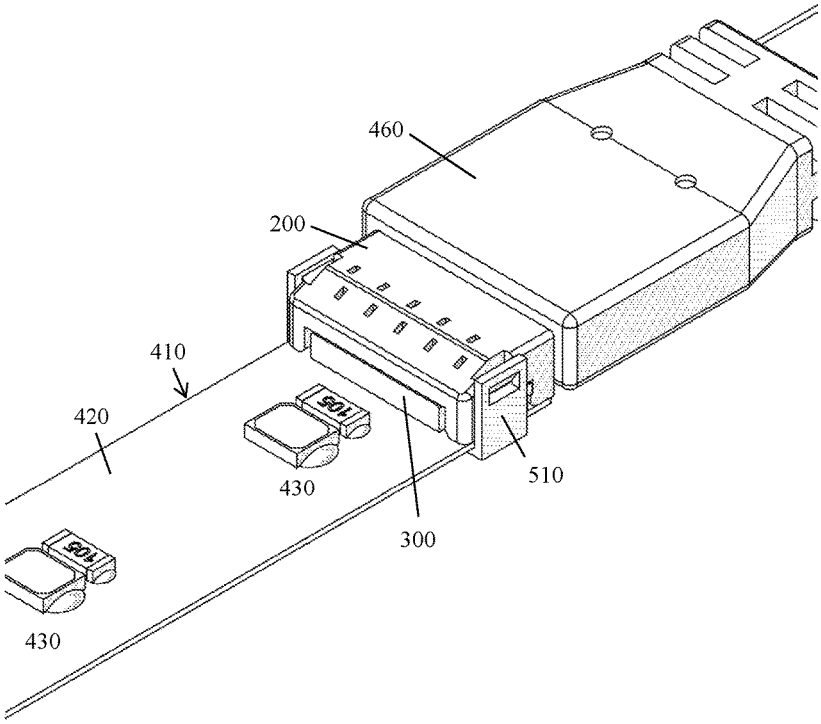
FIG. 5D shows a perspective view of the connector of the electrical connector system shrouded in the cable assembly and the header of the electrical connector system mounted to the flexible printed circuit in a connected state and the optional retention clip secured in place in accordance with one or more embodiments of the present invention.

Continuing, FIG. 5D shows a perspective view of the connector 200 of the electrical connector system 100 shrouded in the cable assembly 460 and the header 300 of the electrical connector system 100 mounted to the flexible printed circuit 420 in a connected state and the optional retention clip 510 secured in place in accordance with one or more embodiments of the present invention.

Figure 5E:
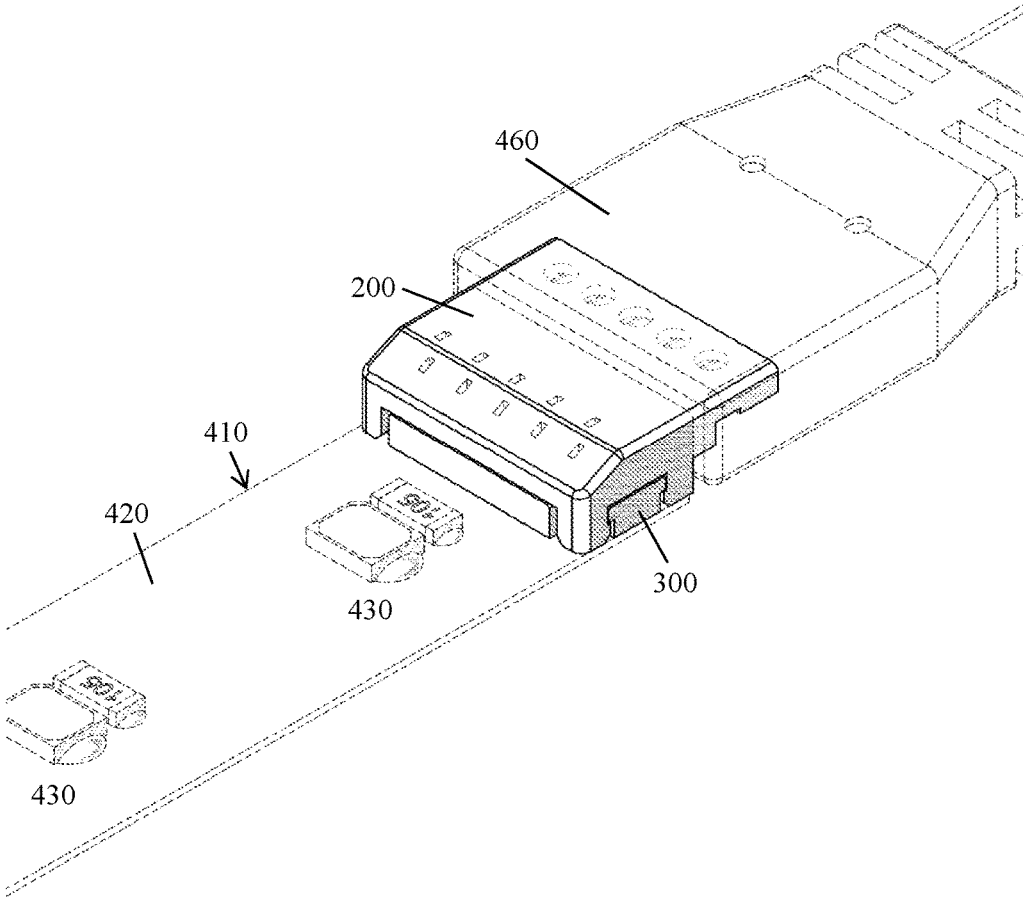
FIG. 5E shows a perspective view of a modified form of the connector of the electrical connector system shrouded in the cable assembly and the header of the electrical connector system mounted to the flexible printed circuit in a connected state in accordance with one or more embodiments of the present invention.

Continuing, FIG. 5E shows a perspective view of a modified form of the connector 200 of the electrical connector system 100 shrouded in the cable assembly 460 and the header 300 of the electrical connector system 100 mounted to the flexible printed circuit 420 in a connected state in accordance with one or more embodiments of the present invention. In certain embodiments, a modified form of the connector 200 may be used that does not include retention clip shoulders (225*a*, 225*b* of FIG. 2).

Advantages of one or more embodiments of the present invention may include one or more of the following:

In one or more embodiments of the present invention, an electrical connector system provides high current connectivity in a low profile form factor with a substantially vertical mating scheme that provides reliable connectivity and high retention force.

In one or more embodiments of the present invention, an electrical connector system may be used in space-constrained applications that have stringent current, connectivity, and profile requirements because of electrical, mechanical, and safety constraints of the circuit.

In one or more embodiments of the present invention, an electrical connector system provides high current carrying capability suitable for use in high current and low profile form factor applications including, but not limited to, LED strip lighting applications. For example, in LED strip lighting applications, the electrical connector system may be capable of conducting 6.25 amperes of current when operated in a 24 volt DC system rated for 150 watt operation. The current, voltage, and wattage may vary based on application or design including, applications with lower wattage requirements, such as NEC class-II rated lighting fixtures rated for less than 100 watts, as well as higher wattage systems rated for more than 150 watt operation.

In one or more embodiments of the present invention, an electrical connector system provides high current carrying capability that may be determined by the type or kind of electrical contact structures, the number of electrical contact structures, the metal surface area of the electrical contact structures, and the wiring interface internal to the connector of the electrical connector system.

In one or more embodiments of the present invention, an electrical connector system may use a type or kind of electrical contact structure that may vary based on an application or design. For example, the type or kind of contact structure used within the system may vary based on the wiring scheme, the number of required contacts, and/or the current carrying requirements for a given application or design. While certain embodiments use a single type or kind of electrical contact structure, one of ordinary skill in the art will recognize that more than one type or kind of contact structure may be used in a given application or design.

In one or more embodiments of the present invention, an electrical connector system may use a number of electrical contact structures that may vary based on an application or design. For example, the number of contact structures used within the system may vary based on the type or kind of electrical contact structures, the wiring scheme, and the current carrying requirement for a given application or design. While certain embodiments use 5 contact-type contact structures, one of ordinary skill in the art will recognize that a different number of contact structures may be used in a given application or design.

In one or more embodiments of the present invention, an electrical connector system may use smaller gauge wiring, such as, for example 24 AWG, internal to the connector disposed in a shrouded cable assembly to achieve a small footprint and connect to larger gauge wiring, such as, for example 18 AWG, outside of the connector portion of the cable assembly for higher-current carrying capacity with improved electrical and mechanical reliability.

In one or more embodiments of the present invention, an electrical connector system provides improved safety over conventional electrical connectors used in high-current and space-constrained applications. Conventional electrical connectors tend to loosen over time and become unintentionally disconnected. Because of the high currents being conducted, conventional electrical connectors can arc giving rise to fire safety issues.

In one or more embodiments of the present invention, an electrical connector system may use 5 contact-type contact structures suitable for use in LED strip lighting applications. In certain single color LED strip light embodiments, the 5 contact-type contact structures may be used in any combination and permutation of positive and negative control voltages including but not limited to (−, +, +, +, −). In certain RGB LED strip light embodiments, the 5 contact-type contact structures may be used in any combination and permutation of positive and negative control voltages including but not limited to (+, R−, G−, B−, +). In certain RGB+W LED strip light embodiments, the 5 contact-type contact structures may be used in any combination and permutation of positive and negative control voltages including but not limited to (+, R−, G−, B−, W−). While the above-noted embodiments contemplate 5 contact-type contact structures, the type and the number of contact structures may vary based on an application or design, including other configurations used in LED strip light applications.

In one or more embodiments of the present invention, an electrical connector system provides a low-profile form factor with a small footprint that achieves secure and reliable electrical and mechanical connectivity in space-constrained applications.

In one or more embodiments of the present invention, an electrical connector system has a low-profile form factor with a small footprint that allows for unobstructed electrical and mechanical connectivity in various applications such as, for example, LED strip lighting applications.

In one or more embodiments of the present invention, an electrical connector system provides a low-profile form factor with a small footprint that has a length, width, and height suitable for use in space-constrained applications, such as, for example, LED strip lighting applications where the electrical connector system provides secure and reliable electrical connectivity, does not interfere mechanically with the LED strip lights, and does not interfere with the provision of LED light by the LED strip lights.

In one or more embodiments of the present invention, an electrical connector system provides a low-profile form factor with a small footprint having a length of less than 11 millimeters, a width of less than or equal to 12 millimeters, and a height of less than 4 millimeters. The length, width, and height may vary based on an application or design. The electrical connector system may be modified and/or scaled in accordance with one or more embodiments of the present invention for different applications and designs including those that include a smaller or larger number of electrical contact structures or electrical contact structures of a different type or kind.

In one or more embodiments of the present invention, an electrical connector system provides a low-profile form factor with a small footprint having a connected thickness of less than 4 millimeters.

In one or more embodiments of the present invention, an electrical connector system uses a substantially vertical mating scheme that achieves an extremely low-profile form factor when connected allowing for use of the electrical connector system in applications where the profile of the connector system itself is substantially constrained.

In one or more embodiments of the present invention, an electrical connector system uses a vertical mating scheme that uses hand force to achieve connectivity between the connector and header and, once connected, provides high-retention force that resists disconnection and provides reliable electrical connectivity. In applications that require even more retention force, an optional retention clip may be used. Even though there is a high degree of retention when connected, the shape and design of the connector of the electrical connector system allows for disconnection from the header with hand force by leverage.

In one or more embodiments of the present invention, an electrical connector system provides more reliable electrical connectivity than conventional electrical connectors.

In one or more embodiments of the present invention, an electrical connector system provides improved mechanical connectivity than conventional electrical connectors.

In one or more embodiments of the present invention, an electrical connector system provides secure and reliable electrical connectivity in LED strip lighting applications that does not require the use of cumbersome soldering on the job site.

In one or more embodiments of the present invention, an electrical connector system may be used in LED strip lighting applications where the LED strip lights are often hidden and disposed in space-constrained areas.

In one or more embodiments of the present invention, an electrical connector system may increase the speed at which LED strip lighting may be installed. The electrical connector system provides are far faster manner of connecting LED strip lighting components over soldering solutions.

In one or more embodiments of the present invention, an electrical connector system may reduce the cost of manufacturing LED strip lighting.

In one or more embodiments of the present invention, an electrical connector system may reduce the cost of installing LED strip lighting.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. An electrical connector system comprising:

a header comprising:

a substantially T-shaped member having a proximal portion substantially rectangular in shape having a first width and a distal portion substantially rectangular in shape having a second width greater than the first width, wherein a first end portion of the distal portion that extends beyond a first end of the proximal portion has a substantially T-shape viewed end on with a first proximal guide and a first distal guide on a top side of the first end portion and a first proximal shoulder and a first distal shoulder on bottom surfaces of the first end portion, and wherein a second end portion of the distal portion that extends beyond a second end of the proximal portion has a substantially T-shape viewed end on with a second proximal guide and a second distal guide on the top side of the second end portion and a second proximal shoulder and a second distal shoulder on bottom surfaces of the second end portion, and a plurality of contact receivers disposed in the substantially T-shaped member, wherein each contact receiver includes a contact receiving portion exposed on a top side of the substantially T-shaped member and a substrate connection portion exposed on a bottom side of the substantially T-shaped member; and a connector comprising:

a substantially rectangular member having a proximal portion having a first thickness and a distal portion having a second thickness less than the first thickness on a bottom side of the rectangular member, wherein the proximal portion includes a first proximal foot and a first distal foot extending beyond the first thickness on a bottom side of the proximal portion of the substantially rectangular member along a first edge, wherein the first proximal foot and the first distal foot each include a foot retention shoulder on an interior facing side of the respective foot and a foot guide on an exterior facing side of the respective foot, wherein the proximal portion includes a second proximal foot and a second distal foot extending beyond the first thickness on the bottom side of the proximal portion of the substantially rectangular member along a second edge, wherein the second proximal foot and the second distal foot each include a retention shoulder on an interior facing side of the respective foot and a foot guide on an exterior facing side of the respective foot, and a plurality of contacts, wherein a portion of each contact is disposed in the rectangular member, an exposed portion of each contact extends beyond the first thickness on the bottom side of the proximal portion of the rectangular member within an area bounded by the first proximal foot, the first distal foot, the second proximal foot, and the second distal foot, and a distal portion of each contact extends beyond the second thickness on a bottom side of the distal portion of the rectangular member.

2. The electrical connector system of claim 1, the connector further comprising:

a plurality of shroud shoulders disposed on the bottom side of the distal portion of the substantially rectangular member, wherein the plurality of shroud shoulders are configured to secure a shrouded cable assembly to the connector.

3. The electrical connector system of claim 1, the connector further comprising:

a first retention clip shoulder on a first side of the proximal portion of the substantially rectangular member, and a second retention clip shoulder on a second side of the proximal portion of the substantially rectangular member, wherein the first and the second retention clip shoulders are configured to receive a retention clip.

4. The electrical connector system of claim 1, wherein the first proximal foot, the first distal foot, the second proximal foot, and the second distal foot of the connector each include a foot guide on one or more sides of the respective foot.

5. The electrical connector system of claim 1, wherein the exposed portion of each contact of the connector is configured to electrically connect to a contact receiving portion of a corresponding contact receiver of the header.

6. The electrical connector system of claim 1, wherein the plurality of contacts consists of 5 contact-type contacts and the plurality of contact receivers consist of 5 contact-type receivers that, when connected, form 5 contact-type contact structures.

7. The electrical connector system of claim 1, wherein the proximal portion of the substantially rectangular member of the connector is beveled along a width of the proximal portion of the substantially rectangular member on a top side.

8. The electrical connector system of claim 1, wherein a first proximal lengthwise edge on a top side of the substantially rectangular member of the connector has a first proximal lengthwise guide and a first distal lengthwise edge on the top side of the substantially rectangular member has a first distal lengthwise guide.

9. The electrical connector system of claim 1, wherein a second proximal lengthwise edge on a top side of the substantially rectangular member of the connector has a second proximal lengthwise guide and a second distal lengthwise edge on the top side of the substantially rectangular member has a second distal lengthwise guide.

10. The electrical connector system of claim 1, wherein a proximal widthwise edge on a top side of the substantially rectangular member of the connector has a proximal widthwise guide and a distal substantially widthwise edge on the top side of the substantially rectangular member has a distal substantially widthwise guide.

11. The electrical connector system of claim 1, wherein a first widthwise edge on a top side of the proximal portion of the substantially T-shaped member of the header has a first widthwise guide and a second widthwise edge on the top side of the proximal portion of the substantially T-shaped member of the header has a second widthwise guide.

12. The electrical connector system of claim 1, wherein the connector has a width less than or equal to approximately 12 millimeters, a length less than approximately 11 millimeters, and a height less than approximately 4 millimeters.

13. The electrical connector system of claim 1, wherein the connector has a width in a range between approximately 1 millimeter and approximately 20 millimeters, a length in a range between approximately 1 millimeter and approximately 20 millimeters, and a height in a range between approximately 1 millimeter and approximately 20 millimeters.

14. The electrical connector system of claim 1, wherein the connector has a width in a range between approximately 20 millimeters and approximately 100 millimeters, a length in a range between approximately 20 millimeters and approximately 100 millimeters, and a height in a range between approximately 20 millimeters and approximately 100 millimeters.

15. The electrical connector system of claim 1, wherein the header has a first width less than approximately 9 millimeters, a second width less than or equal to approximately 12 millimeters, a length less than approximately 5 millimeters, and a height less than approximately 2 millimeters.

16. The electrical connector system of claim 1, wherein the header has a first width in a range between approximately 1 millimeter and approximately 20 millimeters, a second width in a range between approximately 1 millimeter and approximately 20 millimeters, a length in a range between approximately 1 millimeter and approximately 20 millimeters, and a height in a range between approximately 1 millimeter and approximately 20 millimeters.

17. The electrical connector system of claim 1, wherein the header has a first width in a range between approximately 20 millimeters and approximately 100 millimeters, a second width in a range between approximately 20 millimeters and approximately 100 millimeters, a length in a range between approximately 20 millimeters and approximately 100 millimeters, and a height in a range between approximately 20 millimeters and approximately 100 millimeters.

18. The electrical connector system of claim 1, wherein the connector and the header have a height of less than approximately 4 millimeters when connected.

19. An electrical connector system comprising:

a header comprising:

a substantially T-shaped member having a first-width portion and a second-width portion, wherein the second-width portion includes a first substantially T-shaped end portion and a second substantially T-shaped end portion, each end portion having a guide portion on a top-facing side and a shoulder portion on a bottom-facing surface of the end portion, a plurality of contact receivers disposed in the substantially T-shaped member, wherein each contact receiver includes a contact receiving portion exposed on a top-facing side of the substantially T-shaped member and a substrate connection portion exposed on a bottom-facing side of the substantially T-shaped member; and a connector comprising:

a substantially rectangular member having a first-thickness portion and a second-thickness portion, a first plurality of feet on a bottom-facing side of the first-thickness portion along a first edge, and a second plurality of feet on the-bottom-facing side of the first-thickness portion along a second edge, wherein each foot of the first and the second plurality of feet includes a foot retention shoulder and a plurality of feet guides, and a plurality of contacts, wherein a portion of each contact is disposed in the substantially rectangular member, an exposed portion of each contact extends beyond the first-thickness portion on the bottom-facing side of the first-thickness portion within an area bounded by the first and the second plurality of feet, and a distal portion of each contact extends beyond the second-thickness portion on the bottom-facing side of the first-thickness portion.

* * * * *